US008819901B2

(12) United States Patent
Muratsubaki et al.

(10) Patent No.: US 8,819,901 B2
(45) Date of Patent: Sep. 2, 2014

(54) ADJUSTER OF STRING-END-FIXING PORTION OF ARTICLE

(75) Inventors: Koji Muratsubaki, Toyama (JP); Miki Yamazaki, Toyama (JP); Fa Wen Tseng, Taoyuan County (TW); Hideyuki Matsushima, Taipei (TW)

(73) Assignee: YKK Corporation (JP)

( * ) Notice: Subject to any disclaimer, the term of this patent is extended or adjusted under 35 U.S.C. 154(b) by 2019 days.

(21) Appl. No.: 11/916,957

(22) PCT Filed: Jun. 13, 2006

(86) PCT No.: PCT/JP2006/311845

§ 371 (c)(1),
(2), (4) Date: Jan. 30, 2008

(87) PCT Pub. No.: WO2006/137293

PCT Pub. Date: Dec. 28, 2006

(65) Prior Publication Data

US 2010/0037438 A1 Feb. 18, 2010

(30) Foreign Application Priority Data

Jun. 21, 2005 (JP) ..... 2005-180642
Feb. 10, 2006 (JP) ..... 2006-034232

(51) Int. Cl.

| | |
|---|---|
| ***A44B 19/00*** | (2006.01) |
| ***A44B 19/26*** | (2006.01) |
| ***A41F 1/00*** | (2006.01) |
| ***A44B 19/30*** | (2006.01) |

(52) U.S. Cl.

CPC ..... *A44B 19/26* (2013.01); *A41F 1/008* (2013.01); *A44B 19/308* (2013.01)

USPC ..... 24/381; 24/386; 24/418

(58) Field of Classification Search

USPC ..... 24/418, 381, 386

See application file for complete search history.

(56) References Cited

U.S. PATENT DOCUMENTS

| | | | | |
|---|---|---|---|---|
| 2,042,105 | A * | 5/1936 | Kelley | 191/23 R |
| 2,077,360 | A * | 4/1937 | Gilmore | 24/418 |
| 3,751,732 | A * | 8/1973 | Mott | 2/230 |

(Continued)

FOREIGN PATENT DOCUMENTS

| | | | |
|---|---|---|---|
| JP | 11-020890 | A | 1/1999 |
| WO | WO-03/063635 | A | 8/2003 |
| WO | 03/082041 | A2 | 10/2003 |

*Primary Examiner* — Jack W Lavinder

(74) *Attorney, Agent, or Firm* — Kilpatrick Townsend & Stockton LLP

(57) ABSTRACT

An adjuster of a string-end-fixing portion of an article includes first and second sliders which are mounted on an ordinary fastener chain so as to oppose to each other with shoulder mouths thereof opposed to each other and a connecting member for connecting the first and second sliders. The first slider has a stopper pawl member. The adjuster of the string-end-fixing portion is attached to a handling portion for adjusting a portion, one end of a string or the like is fixed to the first and second sliders or the connecting member while the other end is fixed to the string-end-fixing portion of the article so as to move the string-end-fixing portion, maintain the string-end-fixing portion after adjusting operation of the string-end-fixing portion, and facilitate attaching the string or the like again if a fixing of the string or the like fixed to the slider or the like is released.

6 Claims, 31 Drawing Sheets

(56) References Cited

U.S. PATENT DOCUMENTS 4,350,375 A * 9/1982 Bako ..... 292/24
6,357,086 B1 * 3/2002 Ye ..... 24/381
6,928,703 B2 * 8/2005 Petravic et al. ..... 24/68 R
7,114,223 B2 * 10/2006 Okot ..... 24/424
7,516,523 B2 * 4/2009 Okot ..... 24/385

* cited by examiner

ADJUSTER OF STRING-END-FIXING PORTION OF ARTICLE

CROSS REFERENCE TO PRIOR APPLICATIONS

This is a U.S. national phase application under 35 U.S.C. §371 of International Patent Application No. PCT/JP2006/311845, filed Jun. 13, 2006, which claims the benefit of Japanese Application No. 2005-180642, filed Jun. 21, 2005 and Japanese Application No. 2006-034232, filed Feb. 10, 2006, all of which are incorporated by reference herein. The International Application was published in Japanese on Dec. 28, 2006 as International Publication No. WO 2006/137293 A1 under PCT Article 21(2).

BACKGROUND OF THE INVENTION

1. Field of the Invention

The present invention relates to an adjuster of a string-end-fixing portion of an article used for, for example, various kinds of clothing including shoes, tents, curtains, suspenders or the like.

2. Description of the Related Art

When walking or working in a farm in the rain, people often haul up bottoms of trousers. In a hot day, people often haul up sleeves of a shirt or a jacket. However, it is difficult to keep the bottoms of the trousers or the sleeves of the shirt or the jacket hauled up if no way to maintain them in such a state is adapted. Conventionally, one end of a short tape is sewed on each of bottom edges of the trousers or each of sleeve edges of the shirt or the jacket and a male or a female member of a snap button is attached at a position where each of the bottoms or the sleeves is hauled up. When hauling up the bottoms or the sleeves, a female or a male member of the snap button attached to a free end of the tape is engaged with the male or the female member of the snap button attached to the bottom or the sleeve so as to maintain a hauled up state. However, in a case of using the snap button, since an attaching position of the snap button is fixed, a hauled up position of the bottoms or the sleeves is inevitably fixed and it is difficult to adjust the position.

The above-described problem is solved by an adjuster of a string-end-fixing portion disclosed, for example, by an International application publication No. WO 03/082041 A2 that enables an adjustment of the fixing portion of the string end in a various embodiments by operating a slider. As a basic construction, the adjuster comprises a slider comprising an upper plate, a lower plate and a post portion connecting the upper and lower plates at a center portion thereof with a predetermined gap, and a pair of long tapes each of which has an element row constituted of a plurality of elements that are attached along an opposing side edge of the tape with a predetermined pitch and able to engage and disengage, and the element row being inserted into the gap of the slider. The slider has a structure integrated in such a state where rear mouths in an ordinary slider of a slide fastener are formed in front and rear portions in a direction of a fixing position of a string end and shoulder mouths of an ordinary slider of a slide fastener collide each other. Furthermore, an attaching portion for a string or the like is provided at a lower face of the lower plate for fixing an end of the string while the other end of the string is fixed to an adjusting portion of a fixing position of a string end of an attached edge portion of a cap, an adjusting portion of position of a belt of a bag, an adjusting portion of a width of a back of a grove, an adjusting portion of a fixing position of a shoe string for tightening or the like. The tape with the elements corresponds to a stringer of an ordinary slide fastener.

When the tape with the elements of the adjuster of the string-end-fixing portion is attached to adjusting operation portion for moving the fixing portion of the string end disposed at a portion of the above-mentioned various articles by sewing, and the slider is slid along the element row so as to change a position of the slider, a position of the end of the string or the like attached to the slider is changed and a string-end-fixing portion where the other end of the string or the like is fixed and considered as a second position of any one of the articles is moved and adjusted. Although the slider is slid, the element rows are always engaged before and after the slider, since the both end portions of the slider in a direction of the string-end-fixing portion is formed as rear mouths unlike the ordinary slide fastener.

As aforementioned, according to the adjuster of the string-end-attaching portion of the article disclosed by the International application publication No. WO 03/082041 A2, by sliding the slider along the element row of the tape with the elements, the string-end-fixing portion of the article as the second position is moved to a desired position. Although the International application publication No. WO 03/082041 A2 describes that it is possible to use two sliders, it does not disclose any specific structure. Therefore, it is considered that one slider is used to move the string-end-fixing portion of the article in an actual embodiment. However, the single slider tends to have a complicated shape and structure, which requires complicated processes and long time for manufacturing.

In either case, according to the International application publication No. WO 03/082041 A2, the string or the like, one end of which is attached to the string-end-fixing portion disposed at the lower plate of the slider is generally disposed on an inner face of the article. If the string or the like is exposed on the inner face of the article, it tends to entangle a part of a body of a person wearing or using the article, which may damage the article or make the person fall in a worst case.

In order to prevent this interference of the string or the like disposed on the inner face of the article, as also described in the International application publication No. WO 03/082041 A2, the string or the like is inserted into a string guide cloth in a tunnel shape so as to cover the string or the like, thereby preventing an interfering movement of the string or the like. However, if the string or the like comes off the slider or cut off halfway, the end of the string or the like must be attached to the string-end-fixing portion of the slider again or the string must be replaced. In these cases, since the lower face of the slider is also in the string guide cloth of the tunnel shape, and further both front and rear ends of the slider have a same structure as that of a rear mouth of a slider for an ordinary slide fastener as aforementioned, the element rows before and after the slider are in a engaged state and closed. As a result, it is impossible to attach the end of the string or replace the string.

SUMMARY OF THE INVENTION

The present invention is achieved in order to solve the above-described problems and its specific object is to provide an adjuster of a string-end-fixing portion of an article which enables to move a string-end-attaching portion without using a slider having a complicated shape and structure, to maintain the string-end-fixing portion unless its position is changed again once the string-end-fixing portion of the article is moved, and to attach or change the string or the like easily if the string or the like is loosed from the slider or cut off.

In order to achieve the above-mentioned object, the present invention provides an adjuster of a string-end-fixing portion of an article for changing a second position in the article via a string or the like by operating a handling portion disposed at a first position in the article, being characterized in that the handling portion comprises: two tapes, each having an element row of a plurality of elements for engaging and disengaging the element row being fixed along an opposing side edge portion thereof; first and second sliders in which both element rows are inserted and which engage and disengage the elements by sliding operation thereof; and a connecting member for connecting the first and second sliders, wherein any one of the first slider, the second slider and the connecting member comprises a string-end-attaching portion for attaching the string or the like, one end of the string or the like is attached to the string-end-attaching portion and the other end of the string or the like is attached to the second position in the article, each of the first and second sliders comprises an upper plate, a lower plate, a post portion for defining an element guide channel between the upper and lower plates and connecting the upper and lower plates, and a connecting-member-mounting portion disposed on a top face of the upper plate, and the first and second sliders are connected via the connecting member so that the post member of each of the first and second sliders is opposed to each other.

According to the adjuster of the string-end-fixing portion of the present invention, it is preferable that the first slider comprises a stopper pawl member for stopping sliding of the first slider by elastically entering a gap between the adjoining elements when the sliding is stopped, and for allowing the sliding of the first slider by separating from the gap between the elements in conjunction with the sliding operation via the connecting member against an elastic urge.

Preferably, the connecting member and the first and/or second sliders are constructed so as to be engaged and disengaged. Furthermore, the connecting member may comprise a connecting portion and a pull portion.

Furthermore, the connecting member may comprise a cover body for covering the first and second sliders from above and a connecting body attached to the cover body for connecting a connecting-member-mounting portion of the first slider and a connecting-member-mounting portion of the second slider. In this case, it is preferable that the connecting body is pivoted on the cover body so as to swing. Furthermore, it is preferable that the string-end-attaching portion is inserted into a gap between the first and second sliders, specifically from a top wall of the cover body into the gap.

The adjuster of the string-end-fixing portion of the invention comprises as its basic construction two tapes with elements corresponding to fastener stringers of a conventional slide fastener, two sliders, namely the first slider and the second slider, having different structures in which each element row is inserted, and the connecting member for connecting the first and the second sliders, as aforementioned. In other words, the invention discloses the adjuster of the string-end-fixing portion which does not use a single slider having a complicated shape as disclosed in the International application publication No. WO 03/082041 A2, but uses two kinds of sliders connected each other. An ordinary slider for a slide fastener can be used for these two kinds of sliders.

In other words, common feature of the two sliders is that end portions on one side in a sliding direction of the upper plate and the lower plate having flanges on right and left thereof are connected by the post portion and an element passage in a Y shape is formed therein. Generally speaking, a pull attaching post is provided on a top face of the upper plate. However, some sliders have pull attaching posts on both the top face of the upper plate and a bottom face of the lower plate in order to enable operation of the sliders on both of upper and lower faces.

Therefore, according to the invention, it is not necessary to manufacture a slider provided with a string-end-fixing portion in particular because it is possible to combine, for example, a conventionally known ordinary slider which does not have a pull attaching post on its lower plate and a slider which has a pull attaching post on its lower plate as well so as to enable sliding operation on both upper and lower faces. In this case, an end of the string or the like is attached to the pull attaching post provided on the lower plate.

Furthermore, according to the invention, the pull attaching post may be eliminated form the slider. In this case, the connecting member is directly attached to the upper plates of the first and second sliders. Alternatively, the pull attaching post on the lower plate may be eliminated. In this case, an end of the string or the like may be attached to, for example, the connecting member for connecting the first and second sliders. Therefore, the pull attaching post is not essential in this invention.

The first and second sliders prepared as aforementioned are disposed so that end portions on a post side are opposed to each other and both sliders are connected via the connecting member. The first and second sliders connected via the connecting member are used as the adjuster of the string-end-fixing portion of the article of the invention after the tapes with the elements are inserted therein. Since the end portions of the post side of the two kinds of the sliders are disposed so as to be opposed to each other, the element rows disengaged by one slider can be always engaged by the other slider. Furthermore, since the connecting member keeps a gap between the sliders in a predetermined distance so as not to separate too far, the element rows can be guided smoothly in the sliders.

Furthermore, the string or the like attached to the adjuster of the string-end-fixing portion of the invention has a free end which is fixed to the second position in the article while the pair of tapes with elements is fixed along an opening portion formed at a handling portion of the string-end-fixing portion which is the first position in the article by sewing. In this state, the sliders are slid via the connecting member along the element rows so as to pull up the string or the like. As a result, the string-end-fixing portion as the second position of the article can be moved to a desired position. Furthermore, by returning the sliders at an original position, the string-end-fixing portion can be moved back to its original position (original state). In the invention, since the handling portion can be disposed at any place, it is possible to dispose the handling portion at a place easy to handle though the string-end-fixing portion is not at hand, thereby easily sliding the slider so as to move the string-end-fixing portion.

Furthermore, in the adjuster of the string-end-fixing portion of the invention, during aforementioned operation, the string or the like attached to a part of the sliders including the connecting member may be loosen off or cut off due to some sort of reasons. In such a case, according to the invention, since there is a gap between the first and second sliders via the connecting member, a state of the string or the like can be seen. Therefore, it is possible to attach the end of the string or the like to the string-attaching portion of the slider or replace with a new string or the like by using a crochet needle or the like without removing a guide cloth in a tunnel shape.

In the invention, the first slider comprises the stopper pawl member having the front-end-stopper pawl. When sliding of the slider is stopped, the front-end-stopper pawl elastically enters and engages in the gap between the elements through the stopper pawl hole formed in the upper plate of the first slider. When the slider is slid via the connecting member, the front-end-stopper pawl of the stopper pawl member disengages from the gap between the elements against an elastic urge by a pulling-up movement of the connecting member in conjunction with the sliding operation, thereby enabling the sliding of the slider. If the sliding operation of the slider is stopped at this time so as to release the pulling-up movement of the connecting member, the front-end-stopper pawl enters and engages in the gap between the adjoining elements due to elasticity, the sliding of the slider is stopped. If the stopper pawl member working in this way is provided in the first slider, the string-end-fixing portion of the article can be arbitrarily moved by sliding the slider. Furthermore, when the slider is stopped, the slider is unable to slide any further. Therefore, the string-end-fixing portion can be securely maintained at a position to which the string-end-fixing portion is moved.

Furthermore, if the connecting member can be separated from the first and second sliders or either one of the first and second sliders, operation for attaching or replacing the string or the like becomes easier. Furthermore, providing the pull portion on the connecting member facilitates the sliding operation of the slider regardless of a shape of a connecting portion.

Furthermore, according to the invention, the connecting member may comprise the cover body for covering the first and second sliders from above and the connecting body attached to the cover body for connecting the connecting-member-mounting portion of the first slider and the connecting-member-mounting portion of the second slider. By covering the first and second sliders and the connecting member with the cover body, it is possible to finish an appearance of the adjuster of the string-end-fixing portion beautifully. Furthermore, the sliding of the slider becomes easier by holding the cover body to move the slider.

In this case, since the connecting body is pivoted on the cover body so as to swing, the connecting body can be swung in an up-and-down direction in conjunction with a movement of the cover body when the cover body is moved. By this swinging movement of the connecting body, the front-end-stopper pawl of the stopper member can be easily disengaged from the gap of between the elements.

Furthermore, since the string-end-attaching portion is inserted into the gap between the first and second sliders, preferably from the top wall of the cover body, the cover body and the string or the like can be integrally connected. As a result, by operating and moving the cover body, the string or the like is pulled so that the string-end-fixing portion can be securely moved.

BRIEF DESCRIPTION OF THE DRAWINGS

FIG. 32 is a perspective view of an enlarged major portion showing an attaching state between a sheet for opening and closing the window and a string or the like.

FIG. 33 is a perspective view of an enlarged major portion showing a hauling up state of the sheet for opening and closing the window by the same string or the like.

FIG. 35 is a side view showing a state in which a cuff of a sleeve portion is narrowed down by the same string or the like.

DETAILED DESCRIPTION OF THE PREFERRED EMBODIMENTS

Preferred modes of the present invention will be described with reference to accompanying drawings according to representative embodiments. In the meantime, the present invention is not restricted to embodiments described below and may be modified in various ways as long as substantially same features are provided and similar effect can be exerted.

First Embodiment

Figure 1:
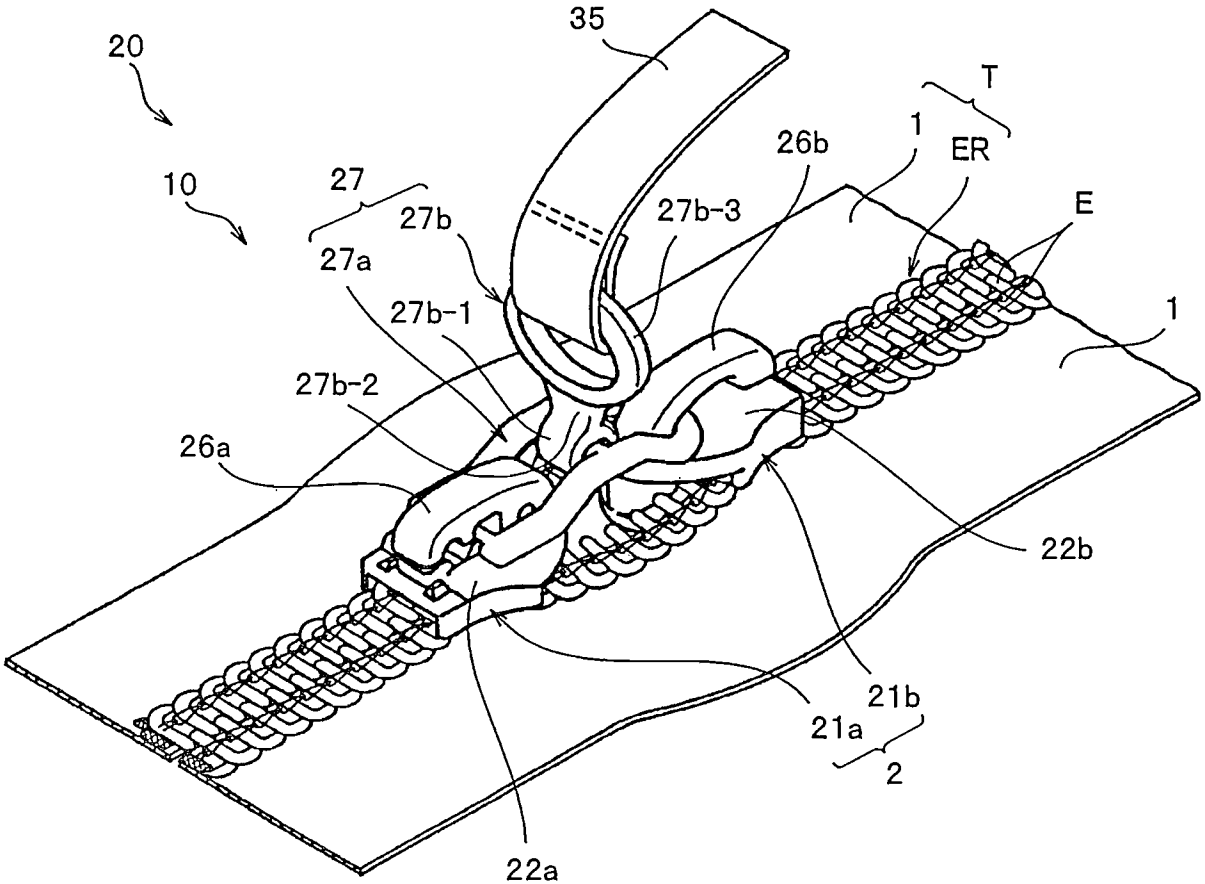
FIG. 1 is a perspective view of a major portion of an adjuster of a string-end-fixing portion according to a first embodiment of the invention.
Figure 2:
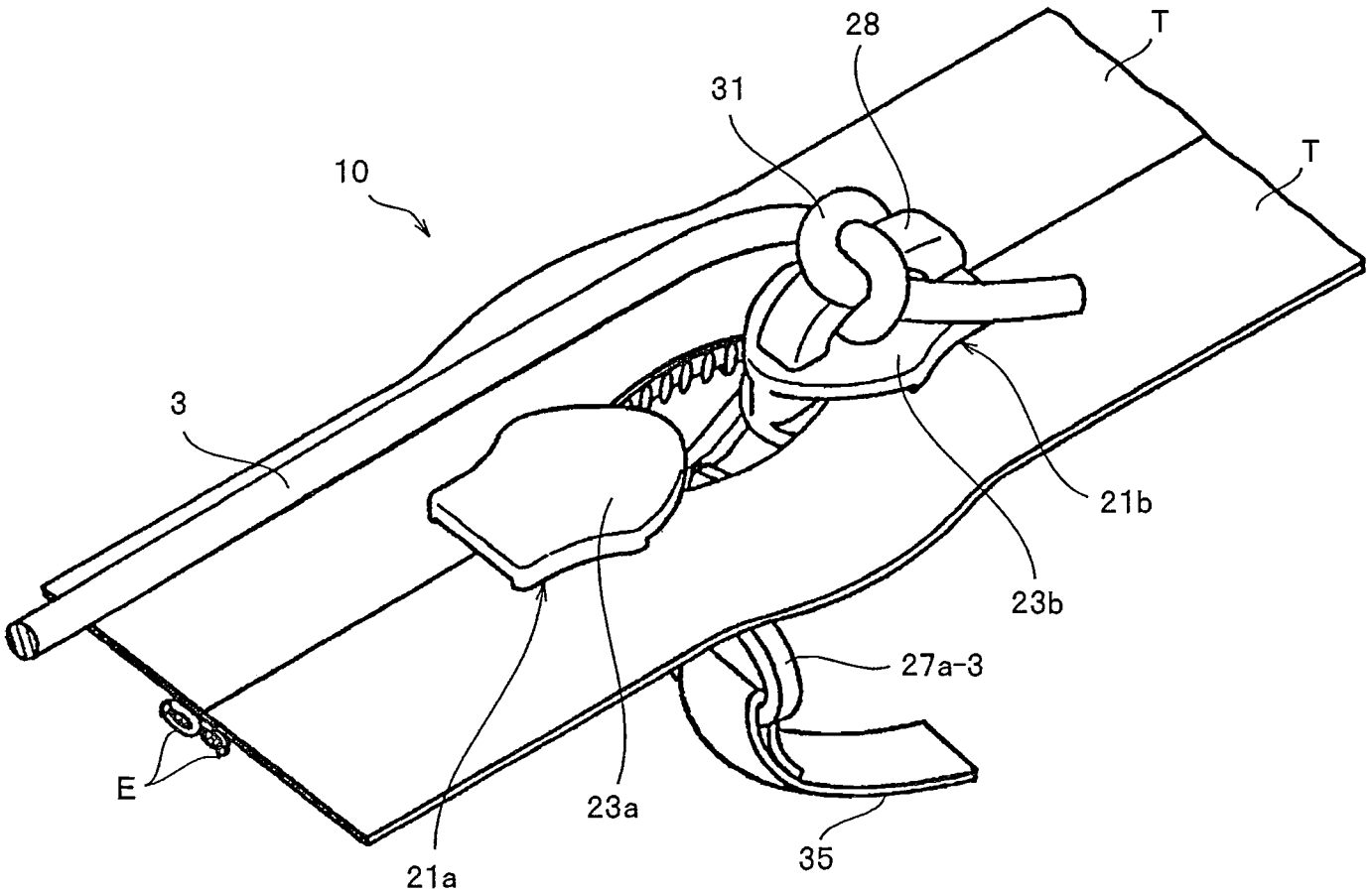
FIG. 2 is a perspective view of the same major portion as seen from its bottom side.
Figure 3:
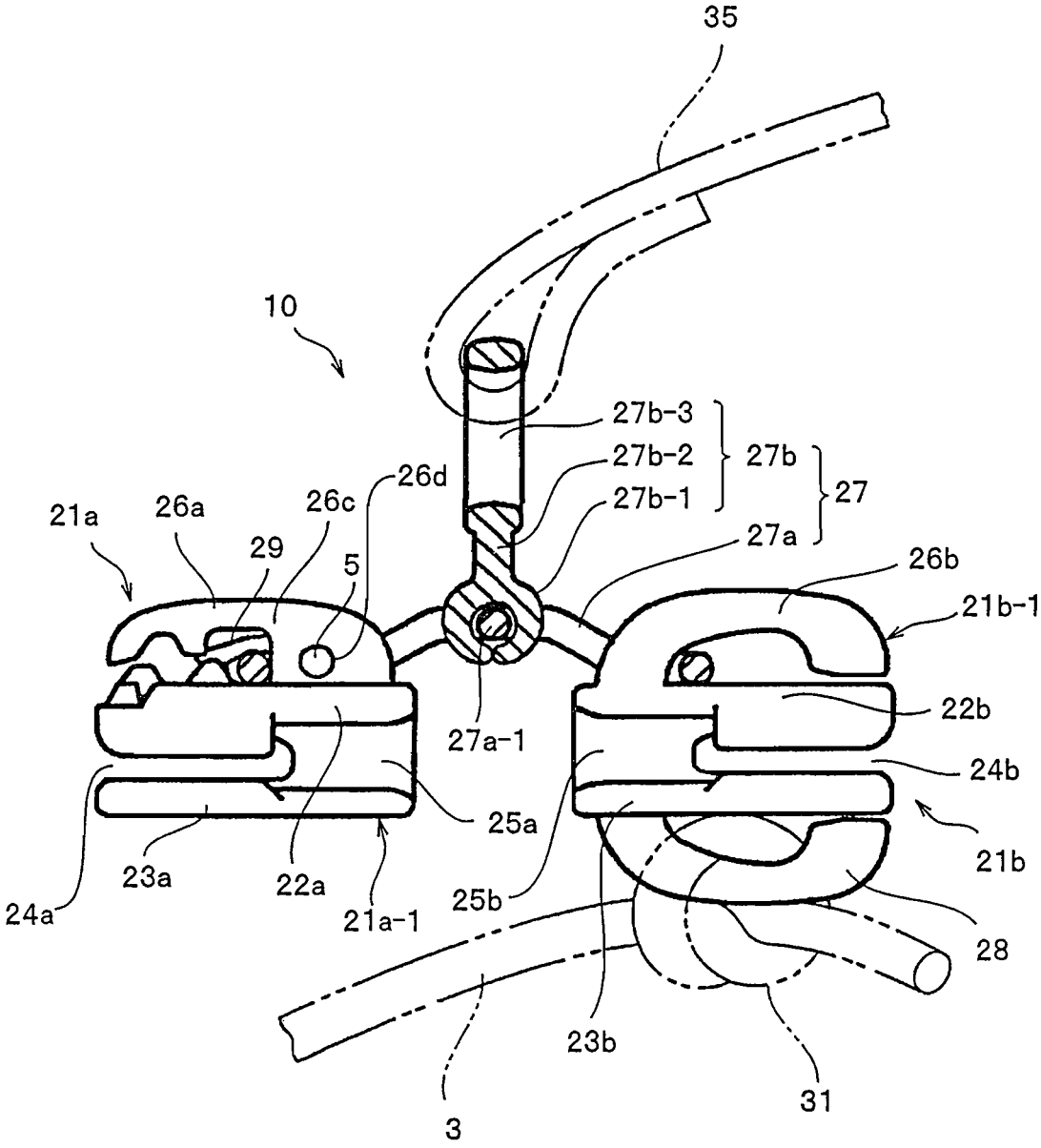
FIG. 3 is a side view showing a cut view of a part of the adjuster of the string-end-fixing portion.

FIGS. 1-5 show a first embodiment of the invention. FIG. 1 is a perspective view of a major portion of an adjuster of a string-end-fixing portion according to a first embodiment of the invention as seen from its front side. FIG. 2 is a perspective view of the adjuster of the string-end-fixing portion as seen from its bottom side. FIG. 3 is a side view showing a sectional view of a part of sliders of the adjuster of the string-end-fixing portion.

As understood from these drawings, a handling portion 20 of an adjuster of a string-end-fixing portion 10 according to the first embodiment is disposed at a first position of an article. The handling portion 20 comprises: two long tapes T, each having an element row ER of a plurality of elements E fixed along an opposing side edge portion of each of the tapes 1, the elements engaging and disengaging each other; a slider 2 constituted of first and second sliders 21*a* and 21*b* in which the element rows are ER inserted and which engage and disengage the elements E by sliding operation thereof; and a connecting member 27 for connecting the first and second sliders 21*a* and 21*b*.

According to the first embodiment, the element row ER is obtained by forming a linear (monofilament) made of thermoplastic resin such as polyester, polypropylene, nylon or the like in a spiral shape. Each element E has a coupling head for engaging with and disengaging from a mating element, upper and lower fixing leg portions which are extended from the coupling head so as to be perpendicular to a side edge portion of the tape 1 and fixed thereon by sewing or the like, and a inverted portion which inverts so as to be connected to an adjoining upper fixing leg portion.

Although the elements E are continuously formed in this embodiment, each of the element E can be formed in dependently and it can be formed of metal instead of the thermoplastic resin. In this case, the element E of the thermoplastic resin is directly formed on the tape 1 and integrated by an injection molding. The element E of the metal is fixed to the tape 1 in such a manner that, for example, leg portions thereof having a Y-shaped cross section are crimped so as to nip the side edge portion of the tape 1. The tape with the elements T obtained in this way has a same structure as that of a fastener stringer of an ordinary slide fastener.

The first and second sliders 21*a* and 21*b* respectively comprise first and second upper and lower plates 22*a*, 23*a*; 22*b*, 23*b*, first and second post portions 25*a*, 25*b* which define element guide channels 24*a*, 24*b* in a Y-shape between the upper and lower plates 22*a*, 23*a*; 22*b*, 23*b* and which connect end portions on one side of the upper and lower plates 22*a*, 23*a*; 22*b*, 23*b*, and first and second connecting-member-attaching post 26*a*, 26*b* which are disposed on top faces of the first and second upper plates 22*a*, 22*b* and extended longwise in a sliding direction of the sliders 21*a*, 21*b* and erected in a gate shape. These first and second connecting-member-attaching post 26*a*, 26*b* serve as a connecting-member-mounting portion. This structure of the sliders 12*a*, 21*b* is same as that of a slider of an ordinary slide fastener.

In the first embodiment, the first and second sliders 21*a*, 21*b* are disposed in such a manner that end portions on sides of the first and second post portions 25*a*, 25*b* are opposed to each other and the element rows ER of the tapes with elements T are inserted therein. This structure is not special as compared with a slide fastener in which two conventional ordinary sliders are used.

However, in the first embodiment, the connecting-member-attaching posts 26*a*, 26*b* of the first and second upper plate 22*a*, 22*b* are connected via the connecting member 27 as aforementioned while a string-attaching portion 28 for attaching one end 31 of the string or the like 3 at a bottom face of the lower plate 23*b* of the second slider 21*b*. It is understood that the first embodiment is different from a conventional ordinary slide fastener in this point. However, there have been a slider having a special structure which enables sliding operation thereof on front and rear face sides by providing pull attaching posts on top face and bottom face of upper and lower plates of the slider, respectively.

Therefore, it is possible to use a conventionally manufactured slider for the slide fastener for the first and second slider of the adjuster of the string-end-fixing portion of the first embodiment. As a result, it is not necessary to manufacture a special slider for the adjuster of the string-end-fixing portion. The adjuster of the string-end-fixing portion 10 of the article having such a structure according to the first embodiment is attached to, for example, a first position of clothing within easy reach of a hand to be described later while one other end 32 of the string or the like 3 is attached to a place of the string-end-fixing portion which is often changed such as a bottom of clothing. With this structure, it is possible, for example, to move a position of the bottom to an arbitrary position.

The connecting member 27 comprises a connecting portion 27*a* for connecting-member-attaching posts 26*a*, 26*b* of the first and second sliders 21*a*, 21*b* and a pull portion 27*b* attached to the connecting portion 27*a*. The connecting portion 27*a* is formed of a ring body in a θ shape in a top view wherein front and rear end portions in a sliding direction of the sliders extend horizontally and incline upward toward a center thereof between the both ends in a mountain shape in a side view, as shown in FIGS. 1 and 3. Furthermore, opposing end portions of the connecting-member-attaching posts 26*a*, 26*b* of the first and second sliders 21*a*, 21*b* are inserted into first and second small ring portions formed in front and rear end portions of the connecting portion 27*a*. As a result, the connecting member 27 prevents the connecting-member-attaching posts 26*a*, 26*b* from being separated to each other beyond a predetermined distance.

As also shown in FIGS. 1 and 3, the pull portion 27*b* comprises a cylindrical lever 27*b*-1 in which a partition lever 27*a*-1 for partitioning the first and second small ring portions of the connecting portion 27*a* is inserted and a pulling tape attaching ring 27*b*-3 connected and integrated with the partition lever 27*a*-1 via a flat plate portion 27*b*-2. A short pulling tape 35 is attached to the pulling tape attaching ring 27*b*-3 in such a manner that one end thereof is inserted in the pulling tape attaching ring 27*b*-3 and folded back.

As shown in FIGS. 2 and 3, the string-attaching portion 28 attached at the bottom face of the lower plate 23*b* of the second slider 21*b* has a same shape as that of the connecting-member-attaching post 26*b* of the second slider 21*b* and the string-attaching portion 28 and the connecting-member-attaching post 26*b* are disposed in a mirror symmetry state with each other interposing the upper and lower plates 22*b*, 23*b* of the second slider 21*b*. The other end 32 of the string or the like 3 is attached to the string-end-fixing portion as the second position of a bottom or sleeve of clothing as aforementioned.

Furthermore, according to the first embodiment, an automatic stopper pawl member 29 is provided in a part of the first slider 21*a*. The stopper pawl member 29 escapes from a gap between the elements E when the slider 2 is in sliding operation and allows a free sliding of the slider 2. On the other hand, when the slider 2 is stopped, the stopper pawl member 29 enters into the gap between the elements E adjoining a stopped position thereof so as not to allow any further sliding of the slider 2. As aforementioned, a well-known stopper pawl mechanism disclosed, for example, by Japanese Utility Model publication No, 4-32974 can be used for the stopper pawl member 29. In this specification, as to the first slider 21*a*, an end where the post portion 25*a* for connecting the upper and lower plate member 22*a*, 23*a* is attached is called as a front end portion and the other end is called as a rear end portion.

Figure 4:
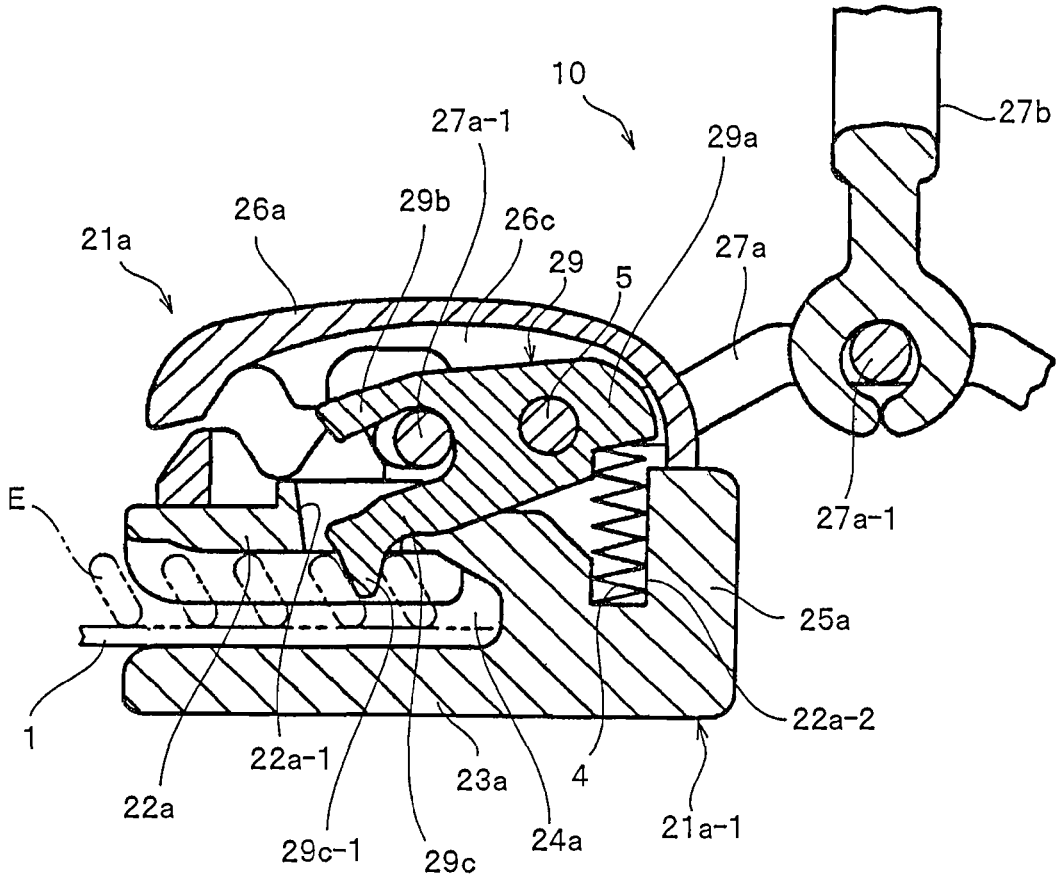
FIG. 4 is a longitudinal sectional view showing a state in which a stopper pawl mechanism provided in a first slider in the adjuster of the string-end-fixing portion engages with elements.
Figure 5:
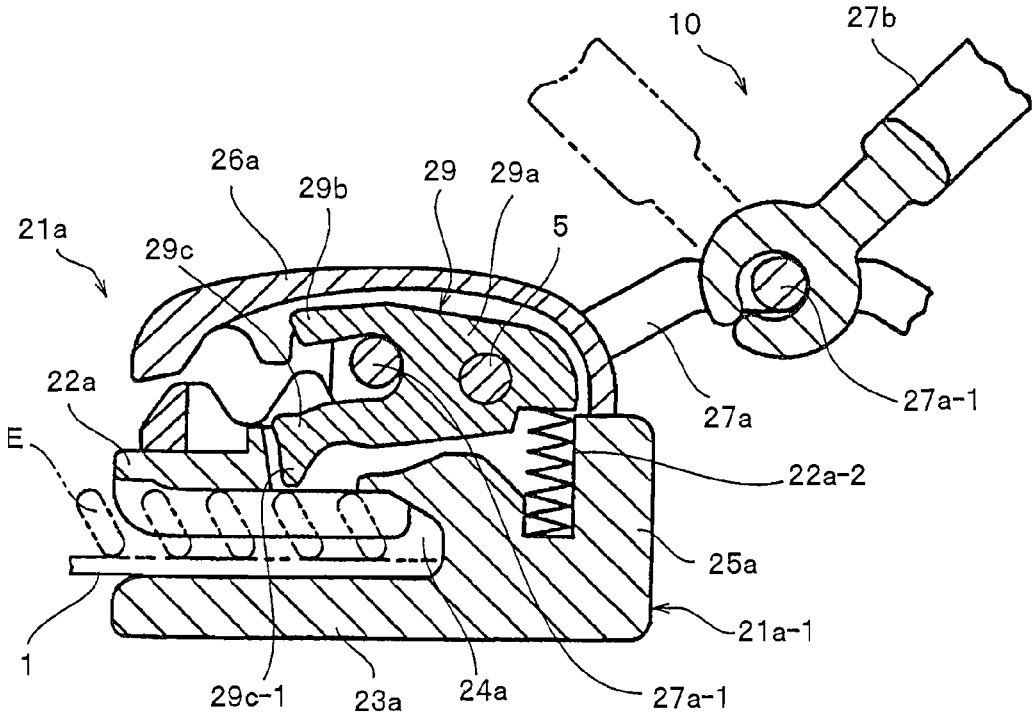
FIG. 5 is a longitudinal sectional view showing a state in which the stopper pawl mechanism is disengaged from the elements.

The stopper pawl mechanism is briefly described herein after with reference to the stopper pawl mechanism disclosed by the Japanese Utility Model publication No, 4-32974 on a basis of FIGS. 4 and 5. The connecting-member-attaching post 26*a* of the first slider 21*a* shown in the drawings erects from the front end portion of the upper plate 22*a* and inclines downward toward the rear end portion so as to be in a gate shape. The connecting-member-attaching post 26*a* comprises right and left side walls and the stopper pawl member 29 is pivoted at a front side in a inner space between the side walls so as to be rotate in an up-and-down direction. In a meantime, a shape of the connecting-member-attaching post 26*a* is not limited to a shape shown in the drawings.

According to an illustrated example, a base end portion 29*a* of the stopper pawl member 29 is inserted between right and left side walls 26*c* of the connecting member attaching portion 26*a*, a pin 5 is inserted into an axis hole 26*d* formed in the right and left side walls 26*c* and a hole portion formed in the base end portion 29*a* so as to support the stopper pawl member 29 rotatably in an up-and-down direction. The stopper pawl member 29 has a substantially Y shape having arm portions 29*b*, 29*c* branching in up and down directions from the base end portion 29*a* in a side view.

On the other hand, an element engaging window 22*a*-1 which is a stopper pawl entering hole of the invention is formed so as to penetrate in up-and-down direction in a upper plate 22*a* at a portion deflected in a right or left direction from a substantial center. A front-end-stopper pawl 29*c*-1 of the lower arm portion 29*c* branched downward from the stopper pawl member 29 projects into the element guide channel 24*a* through the element engaging window 22*a*-1 and enters and engages in the gap between the elements E of the element row ER guided therein.

Furthermore, an end portion 27*a*-1 of the connecting portion 27*a* of the connecting member 27 is inserted between the upper and lower arm portions 29*b*, 29*c* of the stopper pawl member 29. On the other hand, a hole with a bottom 22*a*-2 extending downward from the top face of the upper plate 22*a* is formed in the post portion 25*a* in the first slider 21*a* and a compressed spring 4 is inserted in the hole with the bottom 22*a*-2. A top end of the compressed spring 4 elastically contacts with a bottom face of the base end portion 29*a* of the stopper pawl member 29. When the slider 2 is stopped, the compressed spring 4 urges the front-end-stopper pawl 29*c*-1 of the stopper pawl member 29 so that the front-end-stopper pawl 29*c*-1 can project into the element guide channel 24*a* through the element engaging window 22*a*-1.

Furthermore, if the pulling tape 35 attached to the connecting member 27 is held and pulled up in sliding operation of the slider 2, the connecting portion 27*a* of the connecting member 27 is brought up against an urge by the compressed spring 4 due to a pulling-up force. With this operation, the stopper pawl member 29 is rotated upward with the front end portion 29*a* as its center so that the front-end-stopper pawl 29*c*-1 is disengaged upward from the element guide channel 24*a*. As a result, an engagement of the front-end-stopper pawl 29*c*-1 entering in the gap between the elements E of the element row ER is automatically released.

Figure 6:
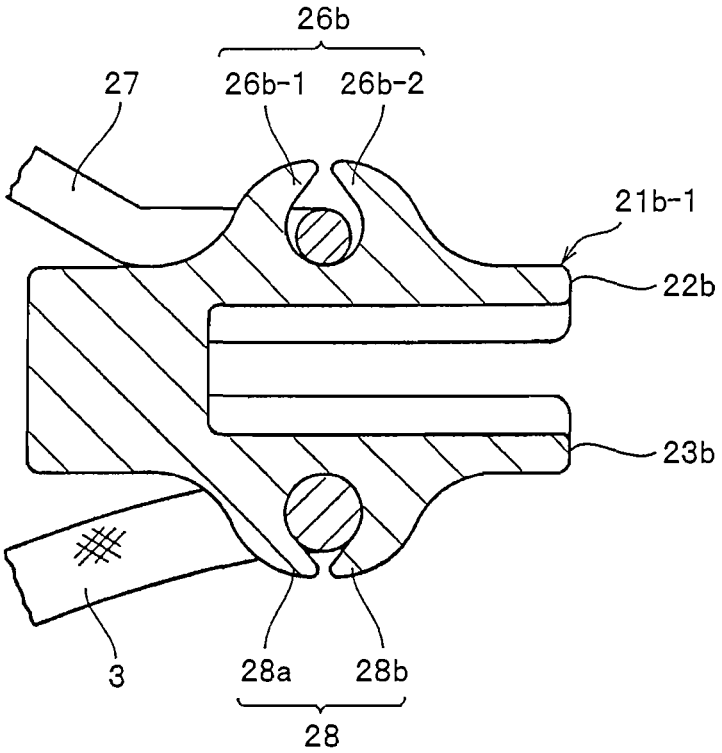
FIG. 6 is a sectional view showing a modified embodiment of a second slider.

FIG. 6 shows a first modified example of the second slider 21*b*. In the first embodiment, the connecting-member-attaching post 26*b* and the string-attaching portion 28 of the second slider 21*b* is integrally formed in a gate shape extending longwise in a sliding direction of a slider body 21*b*-1. On the other hand, in this modified example, a pair of supporting posts erected on a substantially central portion of the upper plate 22*b* of the slider body 21*b*-1 disposed in a sliding direction of the slider body 21*b*-1 with a gap and another pair of supporting posts having a similar shape erected on a substantially central portion of the lower plate 23*b* are integrally formed with the slider body 21*b*-1. the connecting-member-attaching post 26*b* and the string-attaching portion 28 is respectively formed by crimping front end portions of each pair of the supporting posts 26*b*-1, 26*b*-2; 28*a*, 28*b*. By adopting such a structure, manufacturing process of the connecting-member-attaching posts 26*a*, 26*b* and the string-attaching portion 28 can be reduced and manufacturing cost can be largely reduced as well.

Figure 7:
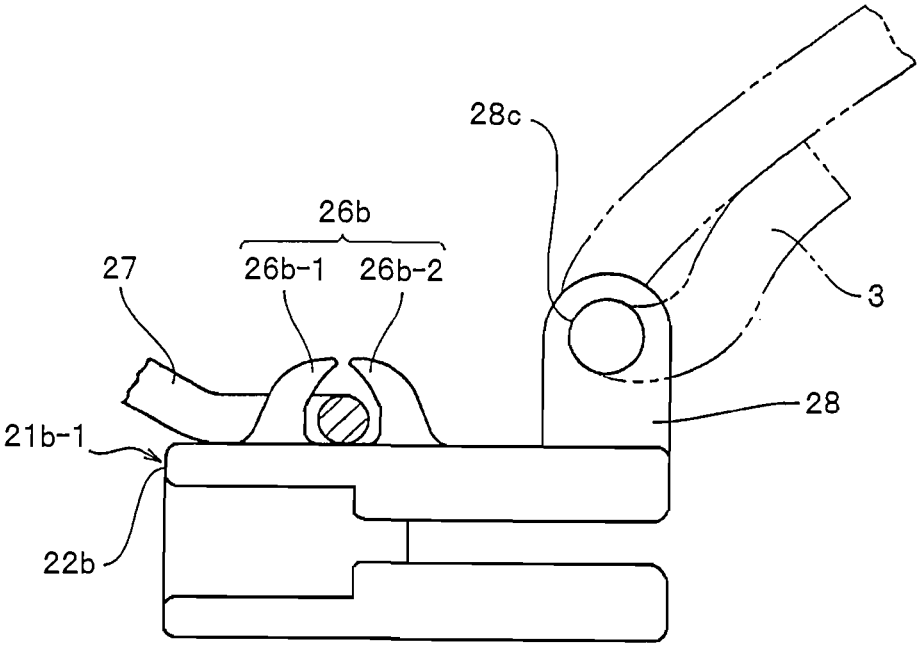
FIG. 7 is a side view showing another modified embodiment of the second slider.

In a second modified example of the second slider 21*b* shown in FIG. 7, a structure of the connecting-member-attaching post 26*b* is same as that of the first modified example. However, it is different from the first modified example in that the string-attaching portion 28 is integrally formed next to the connecting-member-attaching post 26*b* on the top face of the upper plate 22*b*. That is, the connecting-member-attaching post 26*b* is erected on the upper plate 22*b* of the slider body 21*b*-1 on a side of the front end portion and the string-attaching portion 28 is erected on a side of the rear end portion. In the string-attaching portion 28, there is provided a string-inserting hole 28*c* in which the string or the like is inserted and folded to be fixed.

Second Embodiment

Figure 8:
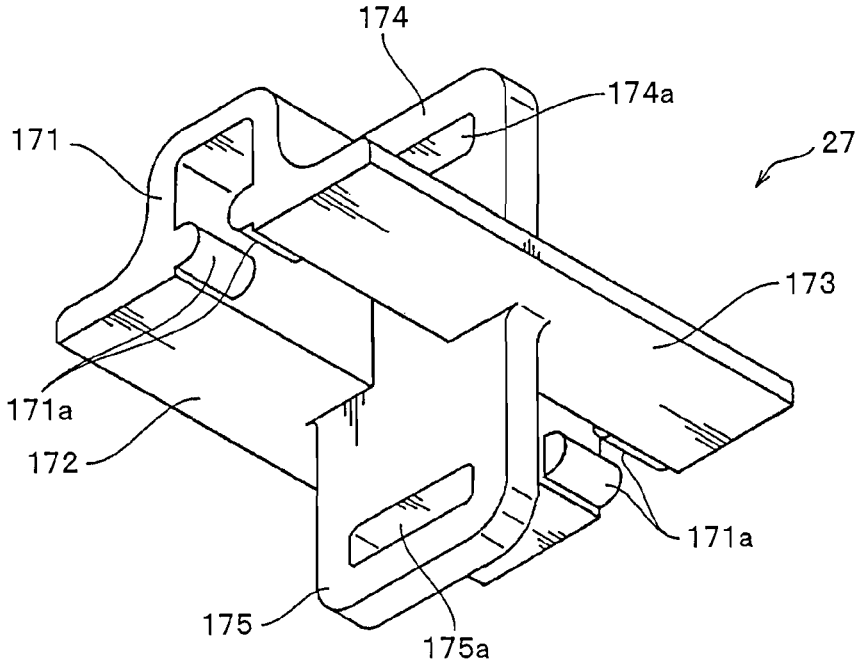
FIG. 8 is a perspective view of a connecting member of an adjuster of a string-end-fixing portion according to a second embodiment viewed from beneath.
Figure 9:
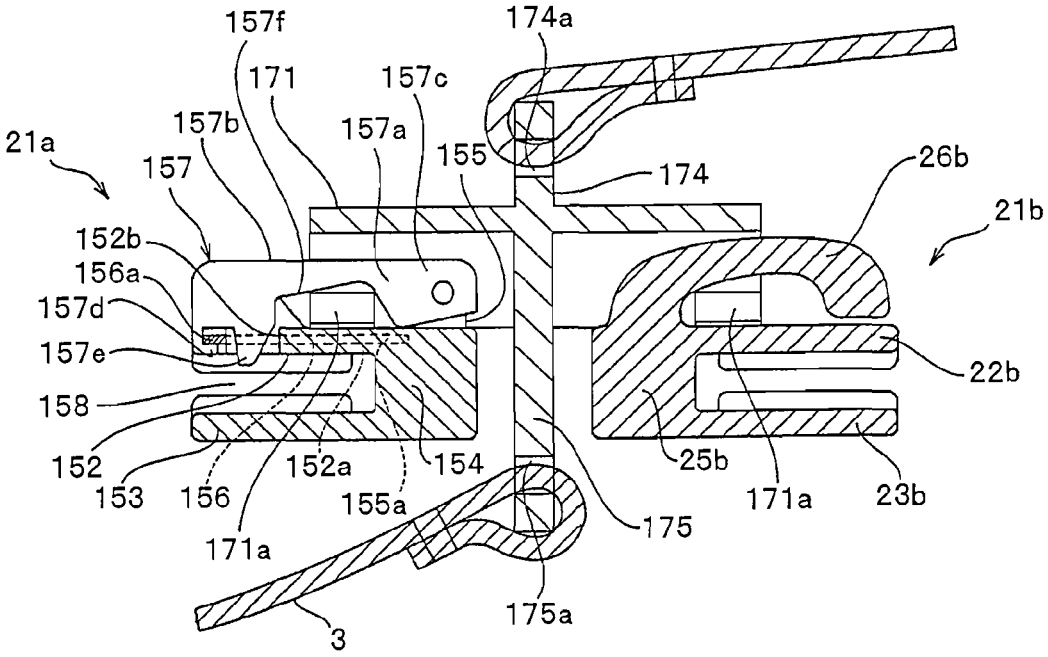
FIG. 9 is a longitudinal sectional view of the adjuster of the string-end-fixing portion in which the same connecting member is mounted.

FIGS. 8 and 9 show a second embodiment of the invention. FIG. 8 is a perspective view of a connecting member 27 of an adjuster of a string-end-fixing portion of an article as obliquely seen from beneath. FIG. 9 is a longitudinal sectional view of the adjuster of the string-end-fixing portion of the article in which first and second sliders 21*a*, 21*b* are connected via the connecting member 27.

As shown in FIG. 8, the connecting member 27 according to the second embodiment is a single body longer in a longitudinal section direction and comprises a tunnel-shaped main body 171 having an inverted U-shaped cross section and extending in a direction of the string-end-fixing portion (sliding direction of the slider), right and left flange portions 172, 173 horizontally extending along each side edges in a width direction of the tunnel-shaped main body 171, and plate pieces 174, 175 having a predetermined width and extending in up and down directions from a center of the tunnel-shaped main body 171 and the right and left flange portions 172, 173 in the direction of the string-end-fixing portion.

At an open side lower end of each end of the tunnel-shaped main body 171 in a longitudinal direction, there is provided a pair of right and left engaging protrusions 171*a* having a half circle cross section and horizontally protruding from an inner wall face of the tunnel-shaped main body 171 in a direction in which both engaging protrusions 171*a* approach each other. The plate pieces 174, 175 extend in up and down directions so as to be perpendicular with respect to the tunnel-shaped main body 171 and the right and left flange portions 172, 173. On sides of front ends of the plate pieces, there are provided a pull inserting hole 174*a* and string inserting hole 175*a* having a same shape longer in a width direction of a plate.

On the other hand, as shown in FIG. 9, as the first slider 21*a* and second slider 21*b* in the second embodiment, well-known slider bodies for a slide fastener having no pull are used without any special process. According to the second embodiment, a stopper pawl 157*e* is also provided in the first slider 21*a* as described later. The stopper pawl 157*e* is integrally formed with a part of a cover body 157 corresponding to a conventional pull attaching post. Furthermore, according to the second embodiment, no string-attaching portion as described in the first embodiment is provided on the bottom face of the lower plate 23*b* of the second slider 21*b*. However, as aforementioned, a plate piece 175 having the string inserting hole 175*a* is formed on the tunnel-shaped main body 171 and the right and left flange portions 172, 173 of the connecting member 27.

The first slider 21*a* is hereinafter described in detail. As shown in FIG. 9, an upper plate 152 and u lower plate 153 is connected via a post portion 154 and a supporting post 155 is projected on an end top face of the upper plate 152 on a side of the post portion 154. A spring fitting groove 152*a* is formed on a top face of the upper plate 152 from the supporting post 155 to an opposite end portion and a spring fixing hole 155*a* is formed inside of the post portion 154 on an extended line of the spring fitting groove 152*a*. A stick-shaped spring 156 is fitted in the spring fitting groove 152*a* and a portion on one end side is inserted and fixed in the spring fixing hole 155*a* while a portion on the other end side projects outside beyond an end portion of the upper plate 152 opposite to the supporting post 155. An end of the cover body 157 is rotatably pivoted on right and left side faces of the supporting post 155 while a hook portion 157*d* of the other end of the cover body 157 is engaged with a projecting end 156*a* of the stick-shaped spring 156 projecting outside beyond the end portion of the upper plate 152.

As a result, the cover body 157 rotates in up and down directions with the supporting post 155 as its center under an influence of en elastic force of the stick-like spring 156. The cover body 157 comprises the right and left side wall portions 157*a* and a top plate portion 157*b* for connecting top end edge portions of the right and left side wall portions 157*a*. The cover body 157 has a narrow and long shape as a whole and an inverted U-shaped cross section. Furthermore, in the right and left side wall portions 157*a*, there is formed window holes 157*f* in which an engaging protrusions 171*a* of the connecting member 27 to be described later is inserted. The cover body 157 having the above-described structures comprises a pivoting portion 157*c* for being pivoted on the supporting post 155 on one end portion thereof and the hook portion 157*d* bending inward on the other end portion thereof. Furthermore, at a part of the end portion of one of the right and left side wall portions 157*a* on a side where the hook portion 157*d* is formed, there is provided a stopper pawl 157*e* so as to project downward which corresponds to the front-end-stopper pawl 29*c*-1 of the stopper pawl member 29 in the first embodiment. The end portion of the cover body 157 on the side where the hook portion 157*d* is formed maintains a horizontal state unless it is rotated against the elastic force of the stick-shaped spring 156 while the stopper pawl 157*e* is also accommodated in a stopper pawl inserting hole 152*b* formed in the upper plate 152 of the first slider 21*a* at all times.

When the connecting member 27 is pulled upward, the cover body 157 largely rotates upward with the supporting post 155 as its center. Accordingly, the hook portion 157*d* lifts a front end of the stick-shaped spring 156 which is elastically deformed and bent in a bow shape. At this time, the stopper pawl 157*e* is in a state that it is out of an element guide channel 158, so that an engagement between the stopper pawl 157*e* and elements is released. Furthermore, when pulling-up of the connecting member 27 is released, the stick-shaped spring bent in the bow shape elastically returns to its original shape and the front end thereof pushes the hook portion 157*d* so as to automatically rotate the cover body 157 downward with the supporting post 155 as its center. Consequently, the stopper pawl 157*e* enters into the element guide channel 158 so as to engage with the elements.

On the other hand, the pair of right and left engaging protrusions 171*a* of the connecting member 27 according to the second embodiment horizontally projects from the inner wall face of the tunnel-shaped main body 171 in the direction in which both engaging protrusions 171*a* approach each other. A narrowest gap between half circle faces is set smaller than a width between outer side faces of the right and left side wall portions 157*a*. However, since the tunnel-shaped main body 171 of the connecting member 27 has an inverted U shape cross section in which both end portions in a direction of the string-end-fixing portion and a bottom face are open, a bottom portion open face can elastically deform in a width direction regardless of material, metal or synthetic resin.

Therefore, when the connecting member 27 according to the second embodiment is assembled to the cover body 157 of the first slider 21*b* having above-mentioned structures according to the second embodiment, an only thing necessary to be done is to strongly push the connecting member 27 to the first slider 21*a* in such a manner that the cover body 157 is sandwiched between the right and left engaging protrusions 171*a* of the connecting member 27. As a result, the tunnel-shaped main body 171 elastically deforms so as to separate the right and left engaging protrusions 171*a*, and then the engaging protrusions 171 fit in the window holes 157*f* of the cover body 157 and elastically returns to their original shapes to be hooked by the window holes 157*f*. In the aforementioned manner, the connecting member 27 is easily assembled with the first slider 21*a*.

On the contrary, when the connecting member 27 is separated from the first slider 21*a*, the connecting member 27 is strongly moved upward to separate while the cover body 157 of the first slider 21*a* is pushed. Accordingly, the tunnel-shaped main body 171 is elastically deforms so as to separate the right and left engaging protrusions 171*a*, thereby removing the connecting member 27 from the window holes 157*f* and easily separating the connecting member 27 from the first slider 21*a*. With this function, the connecting member 27 can be separated from the first slider 21*a* or the connecting member 27 can be assembled with the first slider 21*a*. Therefore, if the string or the like 3 is separated form the string inserting hole 175*a* of the plate piece 175 as the string-attaching portion, or if the string or the like 3 is cut halfway when the adjuster of the string-end-fixing portion according to the second embodiment is used, for example, it is possible to easily attach an end portion of the string or the like 3 to the plate piece 175 again or to replace with a new string or the like.

Third Embodiment

Figure 10:
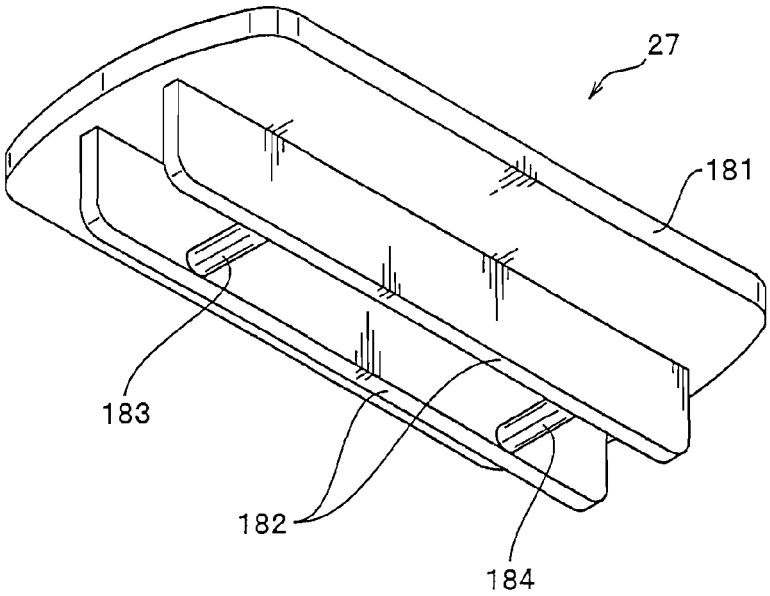
FIG. 10 is a perspective view of a connecting member of an adjuster of a string-end-fixing portion according to a third embodiment viewed from beneath.
Figure 11:
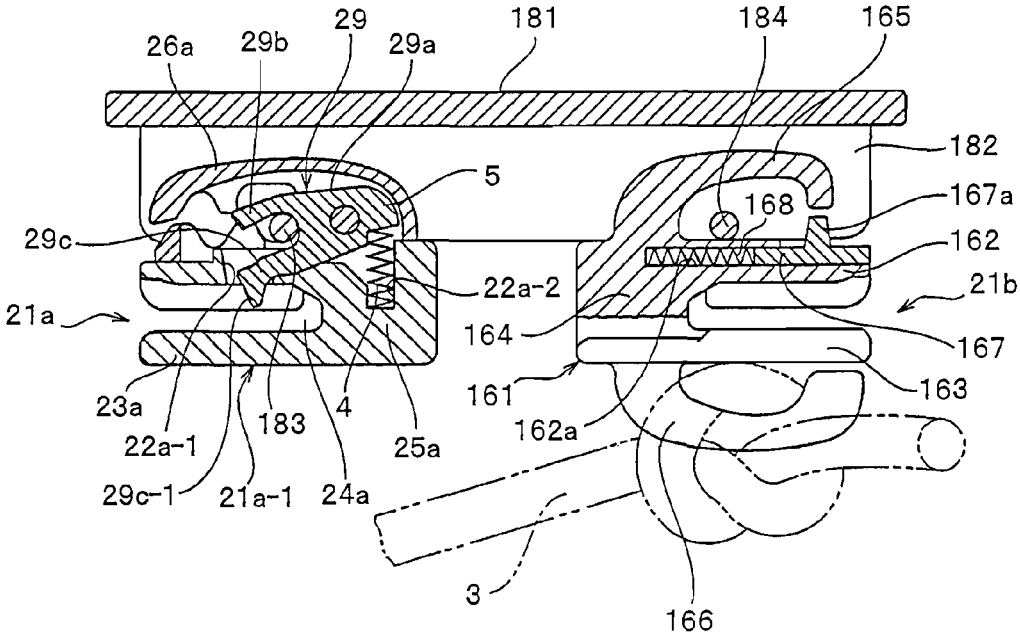
FIG. 11 is a longitudinal sectional view of the adjuster of the string-end-fixing portion in which the same connecting member is mounted.

FIGS. 10 and 11 show an adjuster of a string-end-fixing portion of an article according to a third embodiment of the invention. A connecting member 27 according to the third embodiment comprises a square plate portion 181, two long and narrow square pieces 182 are integrated in a center portion of a rear face of the square plate portion 181 so as to be parallel with a long side portion thereof like blades of a sled, and first and second cylindrical-stick-shaped connecting pieces 183, 184 for connecting the squire pieces 182 at a lower side thereof.

Between the two square pieces 182, the first cylindrical-stick-shaped connecting piece 183 is inserted into a gap between a cover body 26*a* which is a connecting-member-attaching post of the first slider 21*a* according to the third embodiment to be described later and a slider body 21*a*-1 so as to support the first slider 21*a*. On the other hand, the second cylindrical-stick-shaped connecting piece 184 is inserted in a gap between a connecting-member-attaching post 165 of the second slider 21*b* and a slider body 161 so as to support the second slider 21*b*.

The first slider 21*a* according to the third embodiment is substantially same as that of the first slider 21*a* according to the first embodiment in all structures. On the other hand, the second slider 21*a* according to the third embodiment comprise a connecting-member-attaching post 165 erected in a curved manner from a top face of an upper plate 164 corresponding to a post portion 164 for connecting the upper plate 162 and a lower plate 163 of the slider body 161 and extended in a sliding direction of the slider and a string-attaching portion 166 erected in a curved manner from a bottom face of the lower plate 163 and extended in the sliding direction of the slider as the connecting-member-attaching post 165. Furthermore, in a center portion of the upper plate 162 in a right and left width direction, a sliding groove (not shown) is formed in a sliding direction of the slider for holding and guiding a sliding piece 167 having a strip shape and a projection 167*a* projected on a rear end side thereof, and a sliding piece inserting hole 162*a* extending from a halfway of the upper plate 162 to a center portion of the post portion 164 on an extending line of the sliding groove is continuously provided.

A compressed spring 168 is inserted in a back portion of the sliding piece inserting hole 162*a* and a free end of the compressed spring is connected to an end portion on a post portion side of the sliding piece 167. Therefore, if the projection 167*a* is pushed to a side of the post portion 164, the sliding piece 167 is guided to the sliding groove and the sliding piece inserting hole 162*a* against an urge by the compressed spring 168 so as to slide in a direction of the post portion 164. As a result, a gap where the second cylindrical-stick-shaped connecting piece 184 of the connecting member 27 can pass through is formed between the projection 167*a* of the sliding piece 167 and an end portion of the connecting-member-attaching post 165 on an extended side thereof. When a pushing of the projection 167*a* is released, the sliding piece 167 is guide and slid in the sliding groove and the sliding piece inserting hole 162 by an urge of the compressed spring 168 so as to return to a position where the projection 167*a* and the end portion of the connecting-member-attaching post 165 on the extending side is opposed to each other. Consequently, the second cylindrical-stick-shaped connecting piece 184 can not pass through the gap between the projection 167*a* and the end portion of the connecting-member-attaching post 165 on the extended side thereof.

As aforementioned, the adjuster of the string-end-fixing portion 10 of the article according to the third embodiment is assembled by connecting the first and second sliders 21*a*, 21*b* via the connected member 27 and tying an end of the string or the like 3 to the string-attaching portion 166 of the second slider 21*b*. In the first slider 21*a* according to the third embodiment, as aforementioned, when the slider 2 is stopped, the stopper pawl member 29 is urged so that the front-end-stopper pawl 29*c*-1 of the stopper pawl member 29 can project into the element guide channel 24*a* through the element engaging window 22*a*-1. Furthermore, in sliding operation of the slider 2, if the connecting member 27 is held and pulled up, the first cylindrical-stick-shaped connecting piece 183 of the connecting member 27 is lifted upward against an urge by the compressed spring 4 due to a pulling-up force. With this operation, the automatic stopper pawl member 29 rotates upward with the pin 5 inserted into the base end portion 29*a* as its rotation center so that that the front-end-stopper pawl 29*c*-1 is disengaged upward from the element guide channel 24*a*. As a result, an engagement of the front-end-stopper pawl 29*c*-1 entering in the gap between the elements E of the element row ER can be automatically released.

If, for example, a knot of the string or the like 3 is loosed and the string or the like 3 is detached from the string-attaching portion 166 due to some sort of reasons, the sliding piece is slid in the sliding groove and the sliding piece inserting hole 162*a* in a direction of the post portion 164 against an urge of the compressed spring 168 by pushing the projection 167*a* of the second slider 21*b*. With this operation, there is formed a gap between the projection 167*a* and the end portion of the connecting-member-attaching post 165 on the extended side from which the second cylindrical-stick-shaped connecting piece 184 of the connecting member 27 is taken out. After that, if the pushing of the projection 1671 is released, the sliding piece returns to its original position and the gap becomes small.

As aforementioned, by removing the second cylindrical-stick-shaped connecting piece 184, the second slider 21*a* is enabled to freely slide along the element rows ER, which forms an arbitrary opening portion of the string-end-fixing portion where the elements E do not engage each other between the second and first sliders 21*b*, 21*a*. Fingers can be inserted into the opening portion so as to pick up a loosed end of the string or the like 3 and securely tie it to the string-attaching portion 166 of the second slider 21*b*. After that, the sliding piece 167 is slid in a direction to the post portion 164 against the urge by pushing the projection 167*a* of the sliding piece 167 so that the gap is formed between the projection 167*a* and the end portion of the connecting-member-attaching post 165 on the extended side through which the second cylindrical-stick-shaped connecting piece 184 of the connecting portion 27 is inserted. Then, when the pushing of the projection 167*a* is released, the sliding piece 167 is automatically returns to its original position due to an urge of the compressed spring 168, which prevents the second cylindrical-stick-shaped connecting piece 184 from released from the connecting-member-attaching post 165.

As aforementioned, it is easy in the third embodiment as well to attach the string or the like 3 again or replace it when the string or the like 3 is detached from the connecting-member-attaching post 165 or cut off halfway.

Fourth Embodiment

Figure 12:
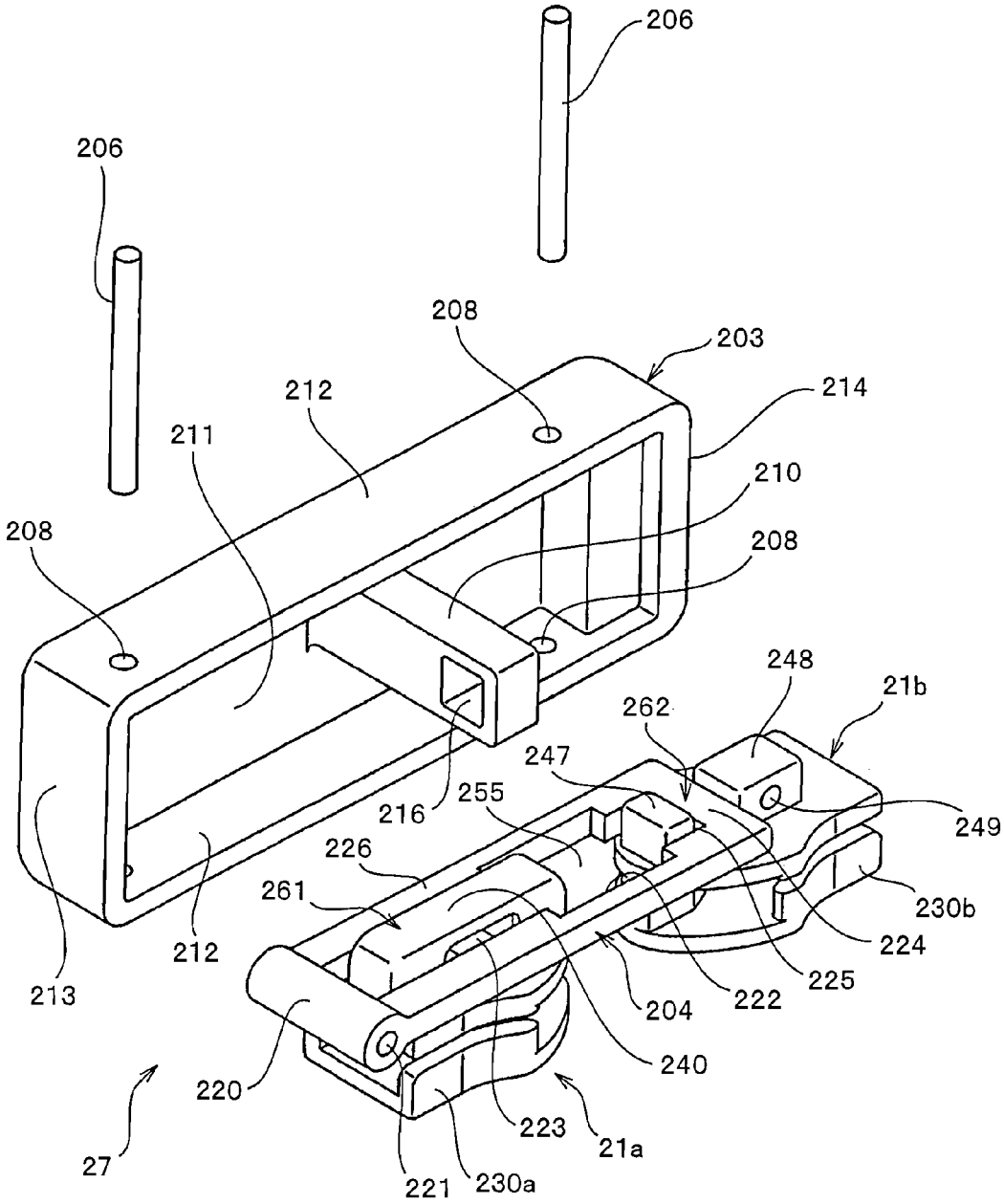
FIG. 12 is an exploded perspective view of an adjuster of a string-end-fixing portion according to a fourth embodiment.
Figure 13:
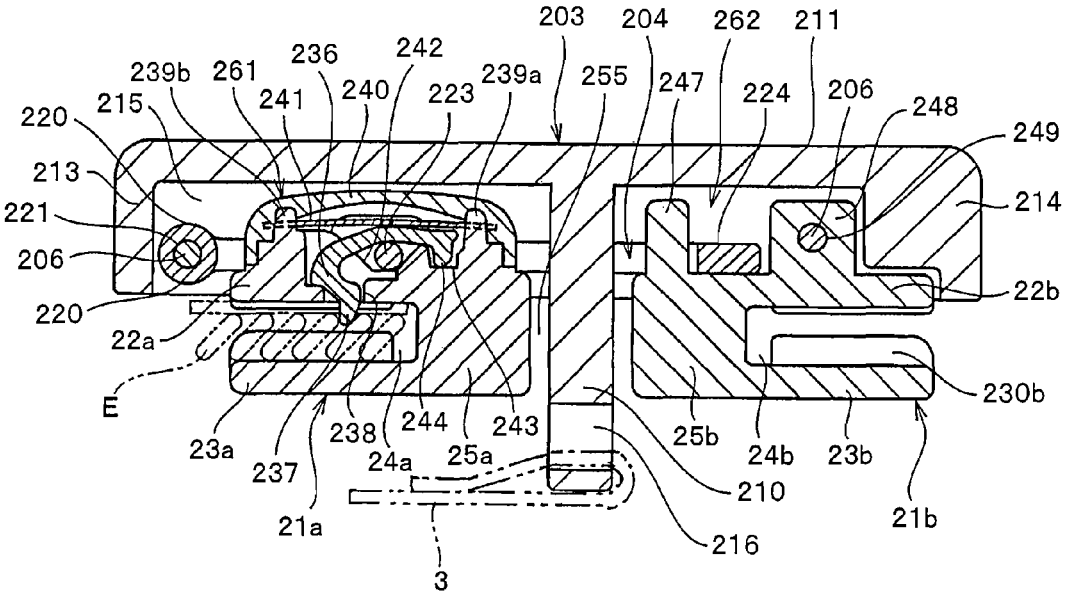
FIG. 13 is a side sectional view of the same adjuster of the string-end-fixing portion.
Figure 14:
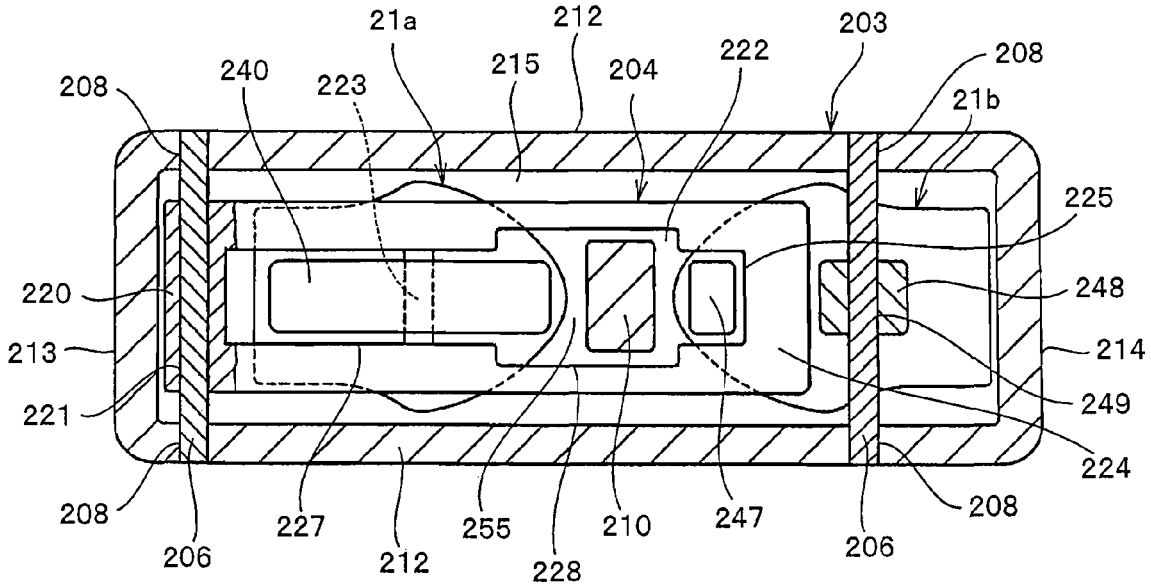
FIG. 14 is a plane sectional view of the same adjuster of the string-end-fixing portion.

FIGS. 12-17 shows an adjuster of a string-end-fixing portion of an article according to a fourth embodiment of the invention. FIG. 12 is an exploded perspective view of the adjuster of the string-end-fixing portion according to the fourth embodiment. FIG. 13 is a side sectional view of the adjuster of the string-end-fixing portion and FIG. 14 is a plane sectional view of the adjuster of the string-end-fixing portion.

A connecting member according to the fourth embodiment, as shown in FIG. 12, comprises a cover body 203 for covering the first and second sliders 21*a*, 21*b*, a connecting body 204 for connecting a connecting-member-mounting portion 261 of the first slider 21*a* and a connecting-member-mounting portion 262 of the second slider 21*b*, and a pin 206 for attaching the connecting body 204 to the cover body 203.

The cover body 203 comprises an upper wall 211, side walls 212 provided downward from right and left side edges of the upper wall 211, front wall 213 provided downward from a front end of the top wall 211 on a side of the first slider 21*a*, a rear wall 214 provided downward from a front end of the top wall 211 on a side of the second slider 21*b* and having a step portion on a inner face side, and a string-attaching post 210 provided downward from a center of the inner face of the upper wall in front and rear directions (sliding direction). In the cover body 203, there is formed an accommodating portion 215 surrounded by the upper wall 211, the right and left side walls 212, the front wall 213 and the rear wall 214.

Pin holes 208 for inserting pins 206 are formed in the right and left side walls 212 on sides of the front wall 213 and the rear wall 214. Furthermore, a string inserting hole 216 for inserting and fixing the string or the like 3 is formed in the string-attaching post 210 at a lower side thereof. The cover body 203 is formed by an injection molding with synthetic resin such as polyester, nylon or the like or soft material such as urethane rubber, thermoplastic elastomer or the like so as to give a good feeling when it is held by fingers or to prevent from giving a damage to a human body or other article when it is in contact.

The connecting body 204 comprises a main portion 226 in a long and narrow shape and a pin inserting portion 220 in which a pin hole 221 is pierced. The connecting body 204 is pivoted on the cover body 203 so as to swing by inserting one of the pins 206 after the pin hole 221 of the pin inserting portion 220 and the pin holes 208 of the cover body 203 on a side of the front wall 213 are matched.

In the main portion 226 of the connecting body 204, an inserting hole 222 piercing in a front-and-rear face direction of the main portion 226 is formed in a long shape in a front-and rear direction and an engaging portion 224 is formed on an end opposite to the pin inserting portion 222. As shown in FIG. 14, the inserting hole 222 comprises a narrow portion 227 in which an attaching cover 240 of the first slider 21*a* is fitted, a wide portion 228 in which the string-attaching post 210 of the cover body 203 is inserted, and an engaging concave portion 225 in which an engaging convex portion 247 of the second slider 21*b* is fitted.

Providing the wide portion 228 in the inserting hole 222 allows the string-attaching post 210 inserted into the inserting hole 222 to be formed thick so that a strength of the string-attaching post 210 is enhanced to prevent breaking thereof. Furthermore, in the narrow portion 227 of the inserting hole 222, an intermediate lever 223 is bridged so as to cross the connecting body 204 in a width direction thereof. Furthermore, the engaging concave portion 225 formed in a concave shape on a side of the engaging portion 224 can engage with the engaging convex portion 247 of the second slider 21*b* to be described later.

The first slider 21*a* comprises the upper and lower plates 22*a*, 23*a*, the post portion 25*a* which define an element guide channel 24*a* in a Y-shape between the upper and lower plates 22*a*, 23*a* and which connects end portions on one side of the upper and lower plates 22*a*, 23*a*, and flanges 230*a* projected upward from right and left side edges of the lower plate 23*a*. Furthermore, a stopper pawl member 236 and a plate spring 241 are attached therein.

Spring attaching posts 239*a*, 239*b* are projected on the top face of the upper plate 22*a* on front and rear end sides. The plate spring 241 is placed on the spring attaching posts 239*a*, 239*b*. Furthermore, an attaching cover 240 is fixed to the spring attaching posts 239*a*, 239*b* so as to cover the spring attaching posts 239*a*, 239*b*, the plate spring 241 and the stopper pawl member 236 to be described later from above. In the upper plate 22*a*, there is formed an element engaging window (front-end-stopper pawl inserting hole) 238 for inserting a front-end-stopper pawl 237 of the stopper pawl member 236 in front of the spring attaching post 239*b* on the rear side. On the other hand, a concave portion 243 is formed in a back of the spring attaching post 239*a* on the front side and a cam face 242 is formed between the concave portion 243 and the spring attaching post 239*b* on the rear side.

The stopper pawl member 236 provided in the first slider 21*a* has a substantially G-shaped cross section. The convex portion 244 to be inserted into the concave portion 243 is formed on one end of the stopper pawl member 236 and the front-end-stopper pawl 237 is formed on the other end. The front-end-stopper pawl 237 is inserted into the element engaging window 238 so as to project into the element guide channel 24*a* and enter in the gap between the elements of the element row ER so as to engage therein.

The second slider 21*b* comprises the upper and lower plates 22*b*, 23*b*, the post portion 25*b* which define an element guide channel 24*b* in a Y-shape between the upper and lower plates 22*b*, 23*b* and which connects end portions on one side of the upper and lower plates 22*b*, 23*b*, and flanges 230*b* projected upward from right and left side edges of the lower plate 23*b*. Furthermore, on the top face of the upper plate 22*b*, the engaging convex portion 247 is erected on a front side and a pin supporting portion 248 having a pin hole 249 in which one of the pins 206 is inserted is erected on a rear side.

According to the fourth embodiment, the first and second sliders 21*a*, 21*b* and the connecting body 204 are molded by a die-cast molding with metal such as zinc alloy or aluminum based alloy or the like. On the other hand, the stopper pawl member 236 and the attaching cover 240 are formed by pressing a steel plate of the like.

In the adjuster of the string-end-fixing portion 10 according to the fourth embodiment, each member is assembled as mentioned hereinafter. Specifically, the intermediate lever 223 of the connecting body 204 is disposed on the cam face 242 of the first slider 21*a* and the stopper pawl member 236 is placed thereon so as to bestride the intermediate lever 223. In other words, as shown in FIG. 13, the intermediate lever 223 of the connecting body 204 is disposed between a bottom face of the stopper pawl member 236 and the top face of the upper plate 22*a* of the first slider 21*a*. The plate spring 241 is placed on the spring attaching posts 239*a*, 239*b* on the front and rear sides so as to bridge therebetween on a top face of the stopper pawl member 236 and the attaching cover 240 for the first slider 21*a* is mounted thereon to cover them.

The engaging convex portion 247 of the second slider 21*b* is fitted in the engaging concave portion 225 of the connecting body 204 disposed in the first slider 21*a*. And the engaging portion 224 is supported between the engaging convex portion 247 and the pin supporting portion 248 so that the first slider 21*a* and the second slider 21*b* is connected with their post portions 25*a*, 25*b* are opposed to each other. With this structure, the first slider 21*a* and the second slider 21*b* are positioned so as not to separate to each other more than required.

Furthermore, the string-attaching post 210 of the cover body 203 is inserted into the inserting hole 222 of the connecting body 204 so that the string-attaching post 210 is disposed in a gap formed between the first slider 21*a* and the second slider 21*b*. By inserting the pin 206 after the pin hole 221 in the pin inserting portion 220 provided on one end of the connecting body 204 and the pin holes 208 provided in the right and left side walls 212 of the cover body 203 on the side of the front wall 213 are matched with the above-mentioned state maintained, the end of the connecting body 204 is pivoted on the cover body 203 so as to swing. With this, the first and second sliders 21*a*, 21*b* connected by the connecting body 204 are covered by the cover body 203.

Figure 17:
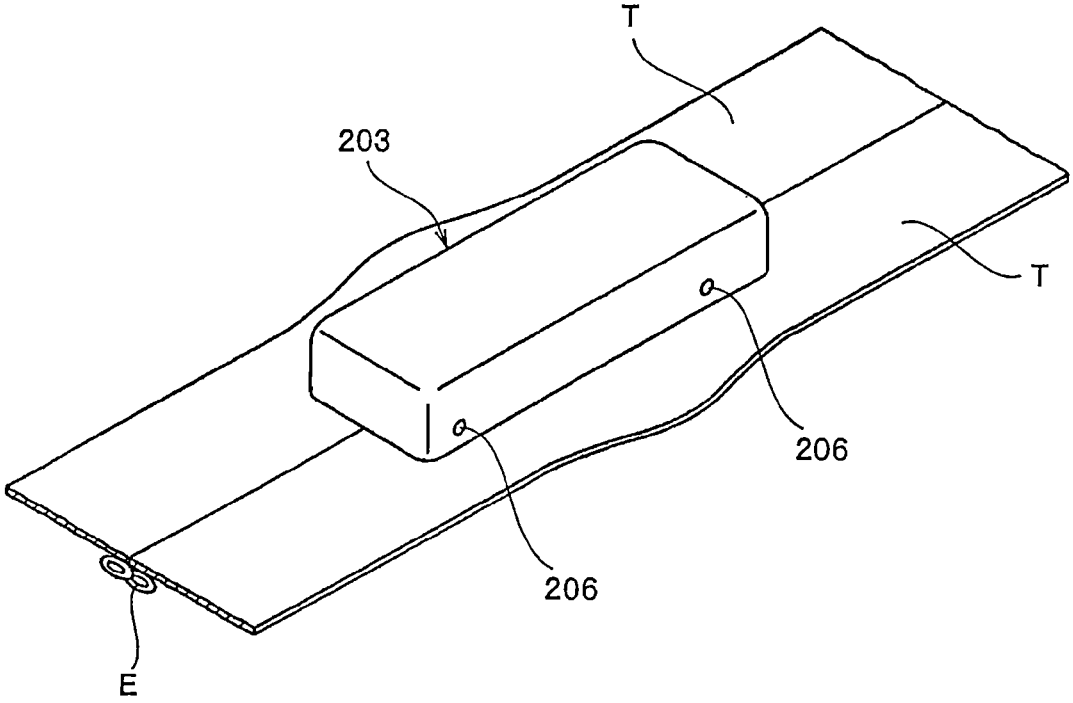
FIG. 17 is a perspective view of the same adjuster of the string-end-fixing portion.

Then, by inserting the pin 206 after the pin hole 248 of the pin supporting portion 248 of the second slider 21*b* and the pin holes 208 formed in the right and left side walls 212 of the cover body 203 on a side of the rear wall 214, the adjuster of the string-end-fixing portion 10 is assembled in such a manner that the cover body 203 is supported on the second slider 21*b* (See FIG. 17.). With this structure, by sliding one of the sliders 21*a* along the element rows ER, the other one of the sliders 21*b* is made to slide together.

Figure 15:
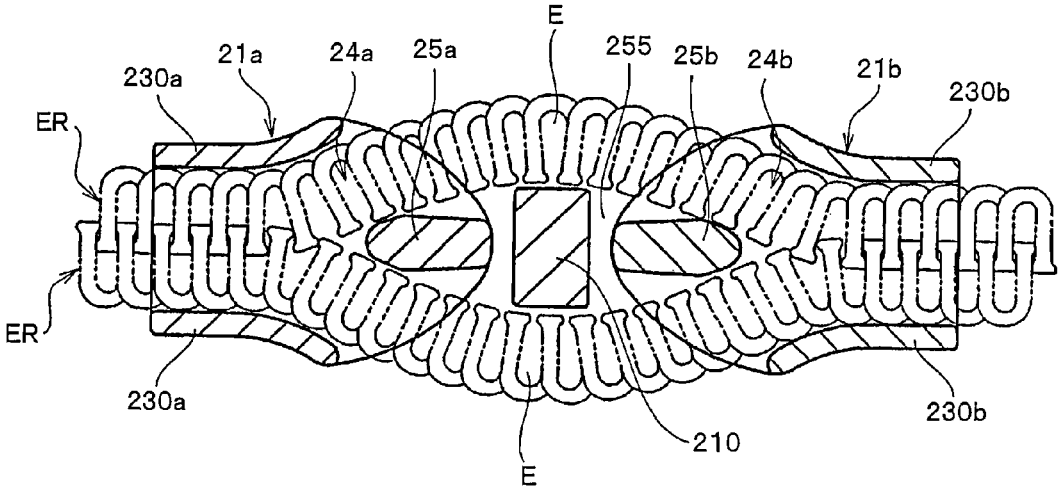
FIG. 15 is a layout view of the same adjuster of the string-end-fixing portion on fastener element rows.
Figure 16:
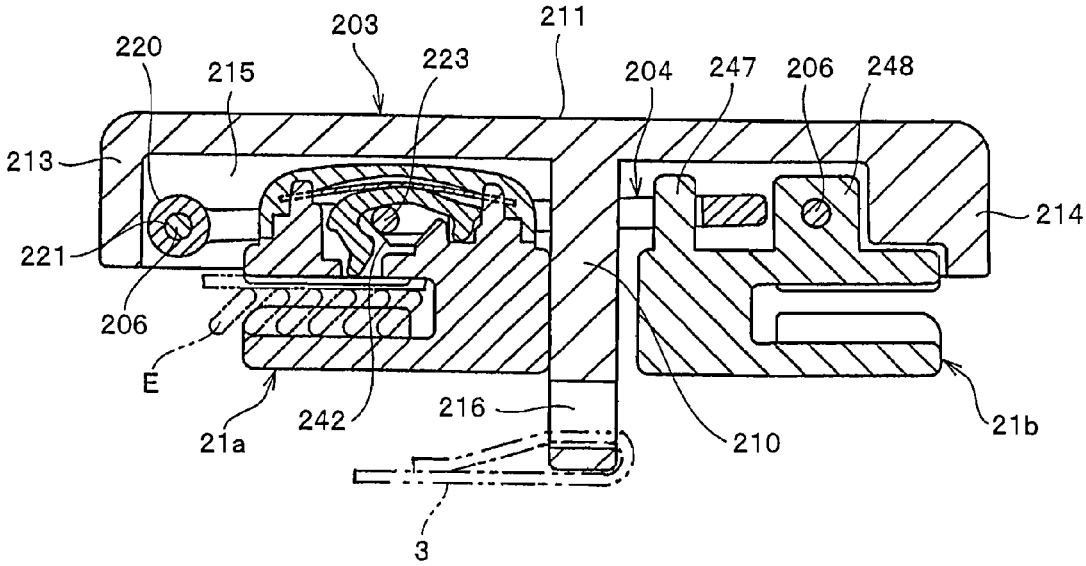
FIG. 16 is a side sectional view showing an actuation of the same adjuster of the string-end-fixing portion.

At this time, the first and second sliders 21*a*, 21*b* are disposed so that the post portions 25*a*, 25*b* thereof are opposed to each other with front end sides thereof (shoulder mouth side) collided with each other. With this structure, as shown in FIG. 15, although the element rows ER on which the first and second sliders 21*a*, 21*b* are mounted are disengaged in the gap 255 between the first and second sliders 21*a*, 21*b*, the element rows ER disengaged by one of the sliders are always engaged by the other one of the sliders.

That is, the element rows ER on which the first and second sliders 21*a*, 21*b* are mounted enter the element guide channel 24*a* from a rear end of one of the sliders 21*a* in an engaging state, are disengaged by the post portion 25*a* while passing through the element guide channel 24*a*, and come out from a front end of the slider 21*a* to the gap 255 in a disengaged state. After that, the element rows ER in the disengaged state enter the element guide channel 24*b* from a front end of the other one of the sliders 21*b*, are engaged while passing through the element guide channel 24*b* and come out from a rear end of the slider 21*b* in the engaged state.

Furthermore, the first and second sliders 21*a*, 21*b* are disposed so as to be separated by a predetermined distance and the gap 255 is formed between the first and second sliders 21*a*, 21*b*. The string-attaching post 210 provided in the cover body 203 is inserted in the gap 255. In the gap, the element rows ER are in the disengaged state as aforementioned, and a space surrounded by the post portions 25*a*, 25*b* and the element rows ER is formed. The string-attaching post 210 is inserted in this space so that a front end of the string-attaching post 210 is extended below the lower plates 23*a*, 23*b* of the first and second sliders 21*a*, 21*b* so as to project on a rear face side of the tapes T. Furthermore, the string or the like 3 is inserted in and fixed to the string inserting hole 216 provided on a front end portion of the string-attaching post 210.

In the adjuster of the string-end-fixing portion 10 according to the fourth embodiment, by holding the cover body 203 by a hand and giving an urge, the intermediate lever 223 of the connecting body 204 is brought up along the cam face 242 disposed in the first slider 21*a* and the connecting body 204 swings upward with the pin 206 as its center. With this, the stopper pawl member 236 is lifted, which elastically deforms the plate spring 241 disposed above the stopper pawl member 236 and removes the front-end-stopper pawl 237 of the stopper pawl member 236 from the element engaging window 238 so that an engagement between the front-end-stopper pawl 237 and the element engaging row ER can be automatically released.

Figure 18:
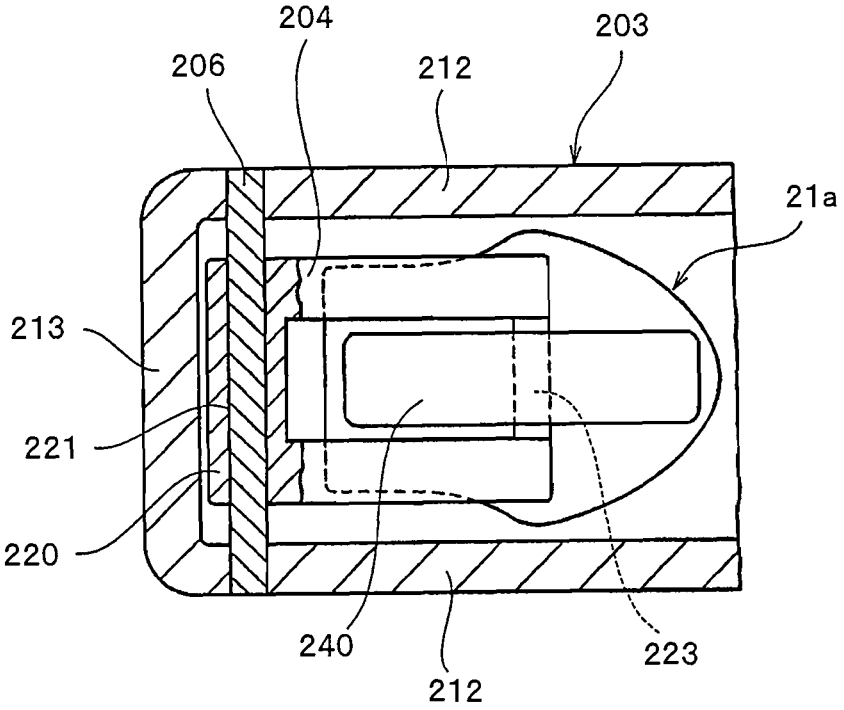
FIG. 18 is a sectional view of a major portion of a modified embodiment of the same adjuster of the string-end-fixing portion.

On the other hand, FIG. 18 shows a modified example of the connecting body 204. The connecting body 204 according to this modified example comprises the intermediate lever 223 to be inserted in a bottom face of the stopper pawl member 236 of the first slider 21*a* on one end and the pin inserting portion 220 having the pin hole 221 piercing therein on the other end. The connecting body 204 is pivoted on the cover body 203 so as to swing by inserting the pin 206 after matching positions of the pin hole 221 of the pin inserting portion 220 and the pin holes 208 of the cover body 203 on the side of the front wall 213.

In the modified example of the connecting body 204 with this structure, by holding the cover body 203 by a hand and giving an urge, the connecting body 204 swing with the pin 206 as its center so that the intermediate lever 223 slid on the cam face 242 to lift the stopper pawl member 236. With this, the plate spring 241 disposed above the stopper pawl member 236 is elastically deformed and the front-end-stopper pawl 237 of the stopper pawl member 236 is removes from the element engaging window 238 so that an engagement between the front-end-stopper pawl 237 and the element engaging row ER can be automatically released. Consequently, the first and second sliders 21*a*, 21*b* can be slid in front and rear direction.

Fifth Embodiment

Figure 19:
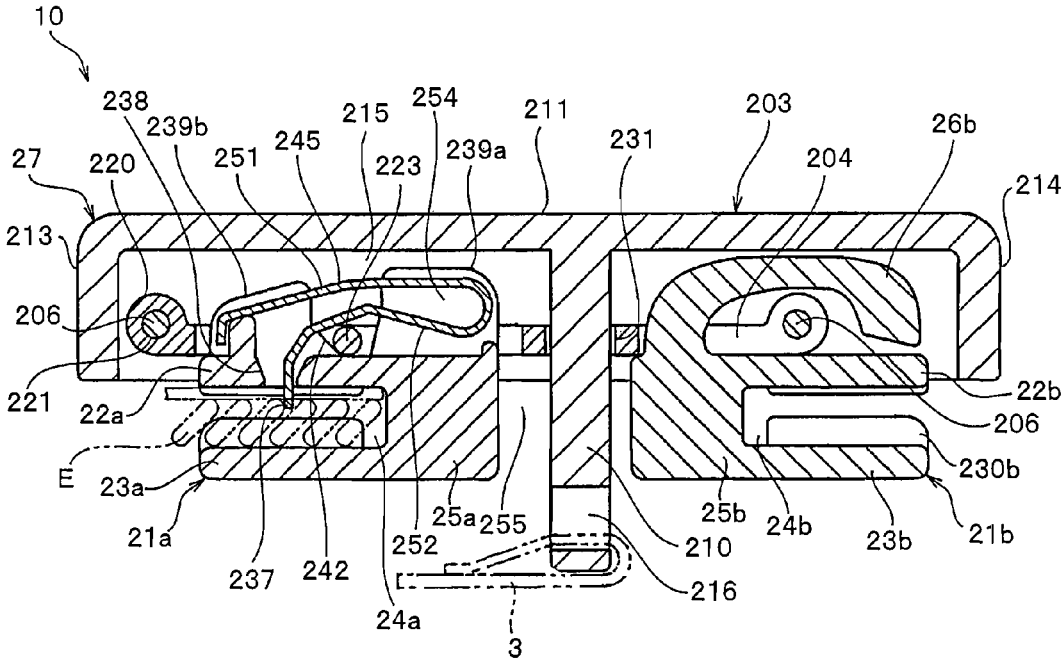
FIG. 19 is a side sectional view of an adjuster of a string-end-fixing portion according to a fifth embodiment.
Figure 20:
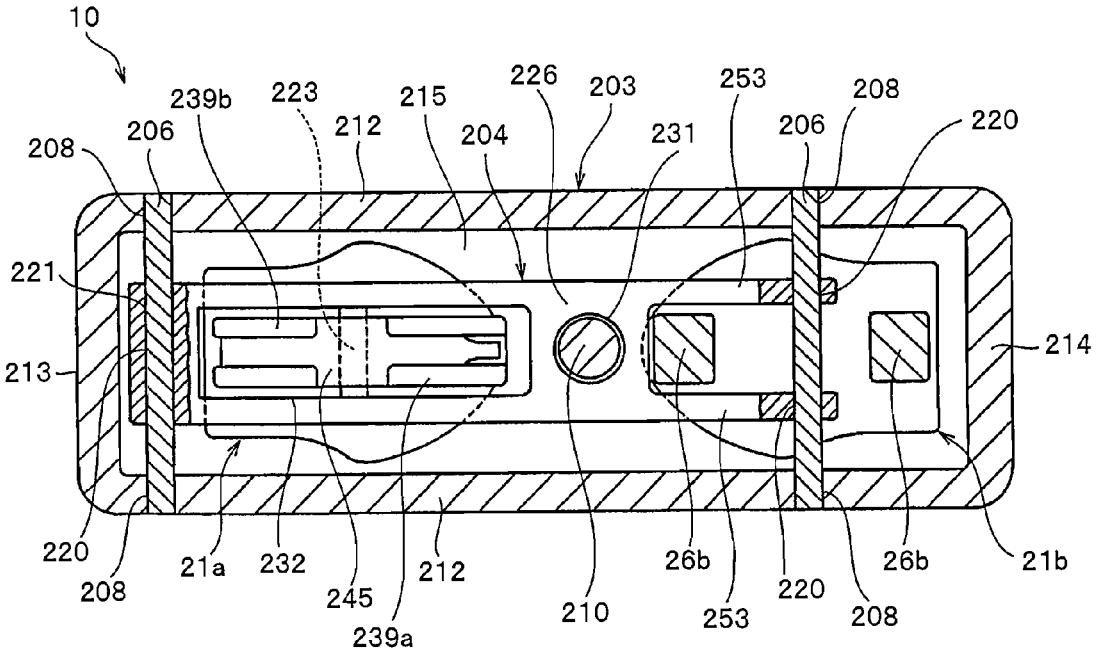
FIG. 20 is a plane sectional view of the same adjuster of the string-end-fixing portion.
Figure 21:
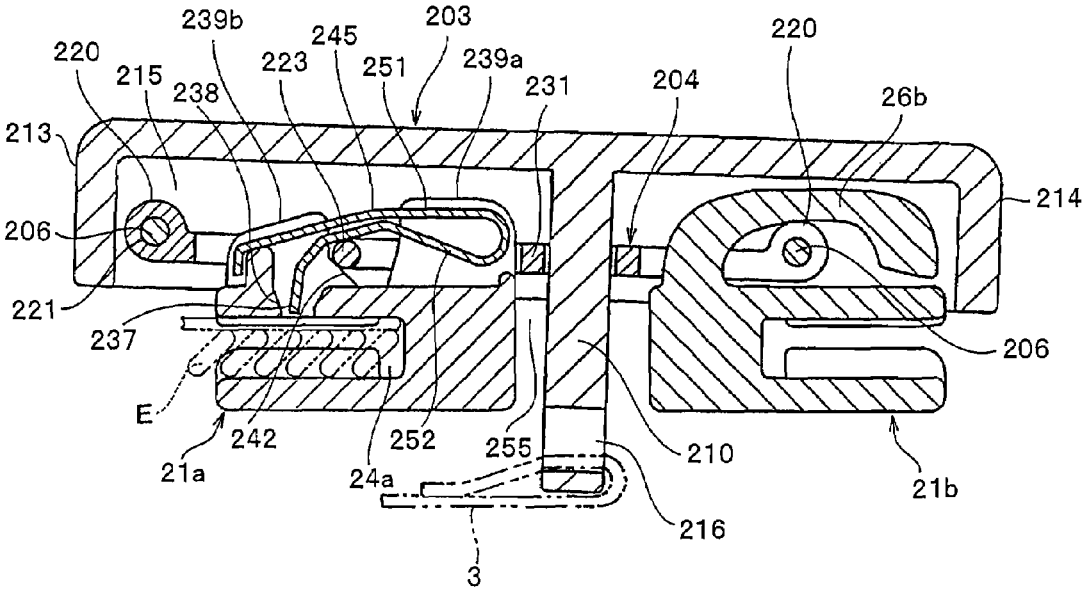
FIG. 21 is a side sectional view showing an actuation of the same adjuster of the string-end-fixing portion.

FIGS. 19-20 show an adjuster of a string-end-fixing portion of an article according to a fifth embodiment. FIG. 19 is a side sectional view of the adjuster of the string-end-fixing portion according to the fifth embodiment. FIG. 20 is a plane sectional view of the adjuster of the string-end-fixing portion. FIG. 21 is a side sectional view showing an actuation of the adjuster of the string-end-fixing portion.

The connecting member 27 according to the fifth embodiment comprises the cover body 203 for covering the first and second sliders 21*a*, 21*b*, the connecting body 204 for connecting the first and second sliders 21*a*, 21*b*, and the pins 206 for connecting the connecting body 204 to the cover body 203.

The cover body 203 comprises the upper wall 211, the side walls 212, the front wall on a side of the first slider 21*a*, the rear wall 214 on a side of the second slider 21*b*, and a string-attaching post 210 with a circle-shaped cross section provided downward from the center of the inner face of the upper wall 211. In the cover body 203, there is formed an accommodating portion 215 surrounded by the upper wall 211, the right and left side walls 212, the front wall 213 and the rear wall 214. Pin holes 208 for inserting pins 206 are formed in the right and left side walls 212 on sides of the front wall 213 and the rear wall 214. Furthermore, the string inserting hole 216 for inserting and fixing the string or the like 3 is formed in the string-attaching post 210 at a lower side thereof.

The connecting body 204 comprises the main portion 226 in a long and narrow shape and the pin inserting portion 220 in which the pin hole 221 is pierced. In the main portion 226 of the connecting body 204, an inserting hole 231 in a circle shape in which the string-attaching post 210 is inserted is pierced at a position corresponding to the string-attaching post 210 of the cover body 203. Furthermore, between the inserting hole 231 and the pin inserting portion 220, there is provided an inserting hole 232 in an oblong shape in which the spring attaching post 239*a*, 239*b* on the sides of the front end and rear end of the first slider 21*a* and a spring with a pawl 245 are inserted. The intermediate lever 223 is bridged in the inserting hole 232 in a width direction of the connecting body 204.

Furthermore, the connecting body 204 comprises a pair of arm portions 253 branched in two directions at an end portion opposite to the pin inserting portion 220. A gap is formed between the pair of the arm portions 253 in which the attaching post 26*b* of the second slider 21*b* can be inserted. Furthermore, at front ends of each of the arm portions 253, there are formed pin inserting portions 220 in which the pin 206 is inserted. Therefore, the connecting body 204 is supported by the cover body by inserting the pin 206 after matching positions of the pin hole 221 of the pin inserting portion 220 and the pin holes 208 in the cover 203.

In the first slider 21*a* according to the fifth embodiment, the spring attaching posts 239*a*, 239*b* for attaching the spring with the pawl 245 are erected on the top face of the upper plate 22*a* on the sides of the front end and rear end with an interval. The cam face 242 in a slope shape is formed between the spring attaching post 239*a* on the side of the front end and the spring attaching post 239*b* on the side of the rear end. Each of the spring attaching posts 239*a*, 239*b* comprises a pair of right and left wall portions 254 and the spring with the pawl 245 is accommodated in the wall portions 254. The right and left wall portions 254 have top walls extended from top ends thereof toward an inside.

The spring with the pawl 245 comprises an upper piece 251 and a lower piece 252 and a front end of the lower piece 252 bends downward to form the front-end-stopper pawl 237. Furthermore, the upper piece 251 of the spring with the pawl 245 is fixed by the right and left wall portions 254 of the spring attaching posts 239*a*, 239*b*. The intermediate lever 223 provided to the connecting body 204 is inserted below the lower piece 252 of the spring with the pawl 245.

The second slider 21*b* comprises the connecting-member-attaching post 26*b* which erects on the top face of the upper plate 22*b* in a gate shape and extends longwise in a sliding direction of the sliders 21*a*, 21*b*. Between the connecting-member-attaching post 26*b* and the upper plate 22*b*, the pin 206 supported by the pin inserting portion 220 formed in the arm portions 253 of the connecting body 204 and pin holes in the cover body 203 is inserted. In the meanwhile, structures of the first and second sliders 21*a*, 21*b* other than those described above is same as those in the fourth embodiment in principle.

In the adjuster of the string-end-fixing portion 10 according to the fifth embodiment, each member is assembled as described hereinafter. Specifically, the intermediate lever 223 of the connecting body 204 is disposed on the top face of upper plate 22*a* of the first slider 21*a* and the spring attaching posts 239*a*, 239*b* of the first slider 21*a* is fitted in the inserting hole 232 of the connecting body 204. The spring with the pawl 245 is placed on the intermediate lever 223 so as to bestride it and the upper piece 251 is fixed to the spring attaching posts 239*a*, 239*b*.

Furthermore, the string-attaching post 210 of the cover body 203 is inserted into the inserting hole 231 in a circle shape formed in the connecting body so that the first and second sliders 21*a*, 21*b* are accommodated in the accommodating portion 215 of the cover body 203. Then, by inserting the pin 206 after matching positions of the pin holes 208 provided in the right and left side walls 212 of the cover body 203 on two sides, the pin hole 221 of the pin inserting portion 220 in a cylinder shape provided on one end of the connecting body 204, and the pin inserting portions 220 provided in the pair of the arm portions 253 on the other end of the connecting body 204, the connecting body 204 is supported by the cover body 203. With this, the first and second sliders 21*a*, 21*b* are connected by the cover body 203 and the connecting body 204, thereby forming the adjuster of the string-end-fixing portion according to the fifth embodiment. At this time, the string-attaching post 210 is disposed in the gap between the first slider 21*a* and the second slider 21*b* and the front end of the string-attaching post 210 projects below the lower plates 23*a*, 23*b* of the first and second sliders 21*a*, 21*b*. The string or the like 3 is inserted and fixed in the string inserting hole 216 formed in the front end of the string-attaching post 210.

In the adjuster of the string-end-fixing portion 10 according to the fifth embodiment, by holding the cover body 203 by a hand and giving an urge, the intermediate lever 223 of the connecting body 204 is lifted along the cam face 242 provided in the first slider so as to move the cover body 203 and the connecting body 204 upward. With this, the lower piece 252 of the spring with the pawl 245 is lifted by the intermediate lever 223 to elastically deform the lower piece 252. At this time, the front-end-stopper pawl 237 disposed at a front end of the upper piece 252 is removes from the element engaging window 238 so that an engagement between the front-end-stopper pawl 237 and the element engaging row ER can be automatically released.

Sixth Embodiment

Figure 22:
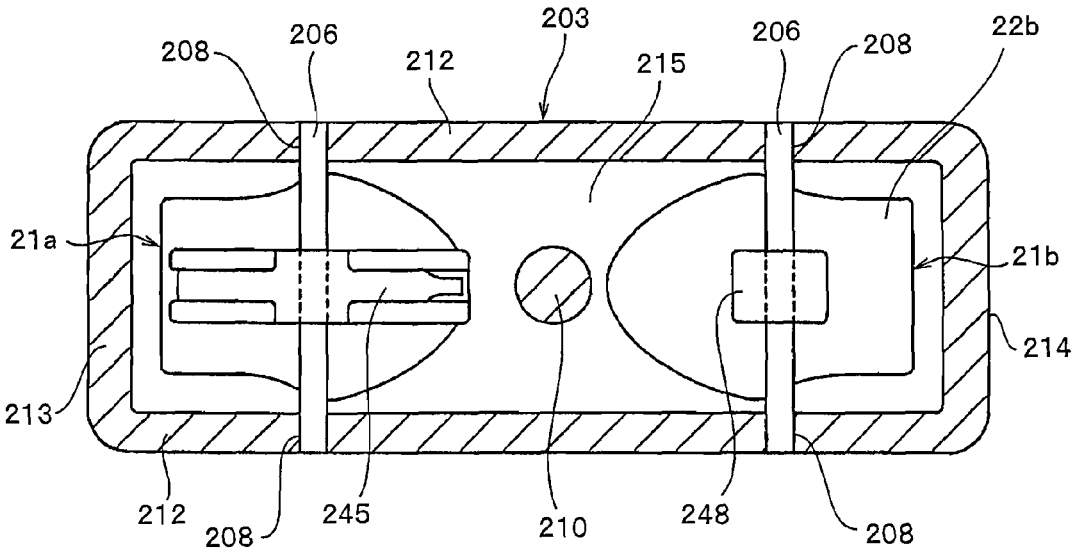
FIG. 22 is a plane sectional view of an adjuster of a string-end-fixing portion according to a sixth embodiment.

FIG. 22 shows an adjuster of a string-end-fixing portion according to a sixth embodiment. FIG. 22 is a plane sectional view of the adjuster of the string-end-fixing portion according to the sixth embodiment.

In the adjuster of the string-end-fixing portion according to the sixth embodiment, the first slider 21*a* of a same type as that in the fifth embodiment is used. As to the second slider 21*b*, it is different from the one in the fifth embodiment in that a pin supporting portion 248 for inserting the pin 206 is projected in a center of the top face of the upper plate 22*b*.

The adjuster of the string-end-fixing portion according to the sixth embodiment, the first and second sliders 21*a*, 21*b* are directly supported and connected by the cover body 203 via the pins 206 without a connecting body. In the first slider 21*a*, one of the pins 206 is disposed beneath the spring with the pawl 245 and the pin 206 is inserted into the pin holes 208 formed in the right and left side walls 212 of the cover body 203. With this structure, if the cover body 203 is moved upward, the spring with the pawl 245 is pushed upward and elastically deformed. Consequently, the front-end-stopper pawl 237 disposed at a front end of the spring with the pawl 245 is removes from the element engaging window 238 so that an engagement between the front-end-stopper pawl 237 and the element engaging row ER can be automatically released.

Seventh Embodiment

Figure 23:
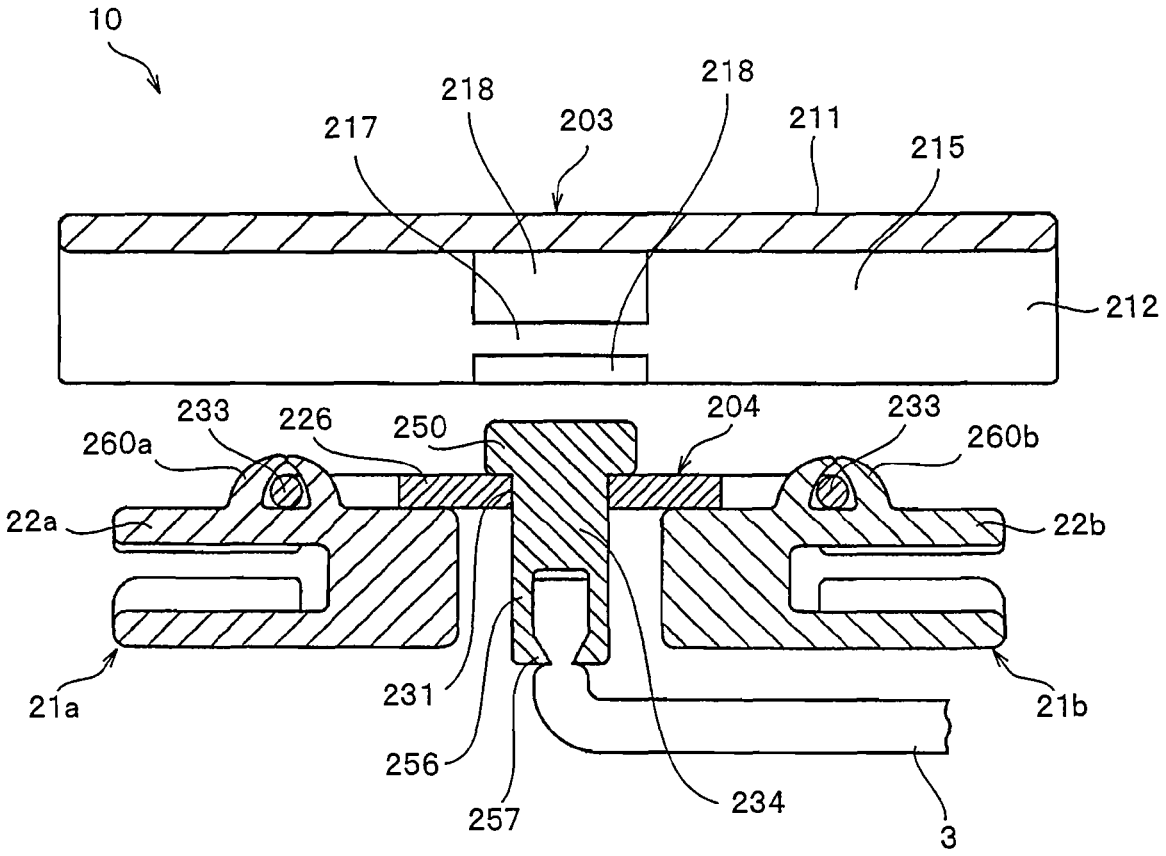
FIG. 23 is an exploded side sectional view of an adjuster of a string-end-fixing portion according to a seventh embodiment.
Figure 24:
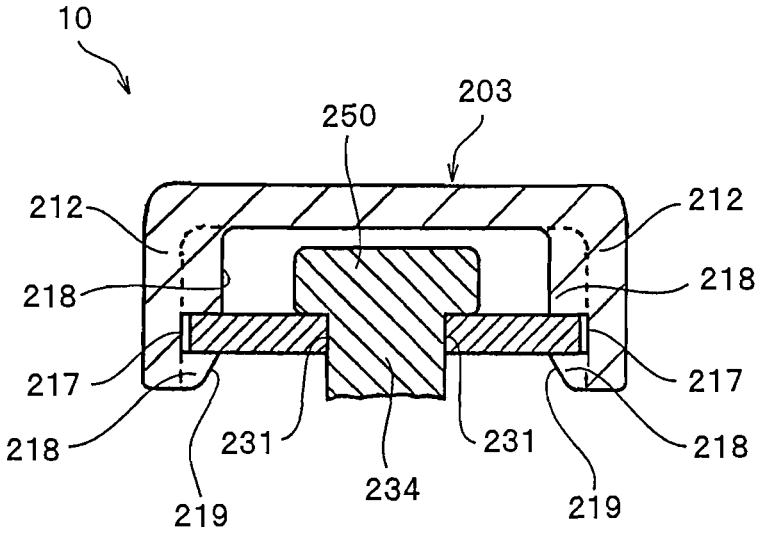
FIG. 24 is a plane sectional view of the same adjuster of the string-end-fixing portion.

FIGS. 23 and 24 shows an adjuster of a string-end-fixing portion of an article according to a seventh embodiment. FIG.

23 is an exploded side sectional view of the adjuster of the string-end-fixing portion according to the seventh embodiment and FIG. 24 is a plane sectional view of the same adjuster of the string-end-fixing portion.

The adjuster of the string-end-fixing portion 10 according to the seventh embodiment is different from the aforementioned embodiments. In this embodiment, an automatic stopper pawl member is not provided in neither the first slider nor the second slider and both of the first and second sliders 21*a*, 21*b* have a same structure. The first and second sliders 21*a*, 21*b* have attaching posts 260*a*, 260*b* respectively on front and rear sides thereof at centers of the top faces of the upper plates 22*a*, 22*b* for directly fixing the connecting body 204.

Furthermore, according to the seventh embodiment, the cover body 203 and the connecting body 204 are provided as connecting members for connecting the first and second sliders 21*a*, 21*b*. The connecting body 204 comprises the main portion 226 in a long and narrow shape and the string-attaching portion 234 to be mounted on the main portion 226 wherein attaching levers 233 are bridged on both ends of the main portion 226. On of the attaching portions 233 is fixed by the attaching post 260*a* of the first slider 21*a* and the other one of the attaching posts 233 is fixed by the attaching post 260*b* of the second slider 21*b*.

Furthermore, the inserting hole 231 of a proper shape is formed in a center of the main portion 226 in which the string-attaching portion 234 is attached. The string-attaching portion 234 is different from that of the aforementioned fourth, fifth and sixth embodiments and is formed separately from the cover body 203. At a lower end portion of the string-attaching portion 234, there are provided a pair of fixing leg portions 256 and fixing projections 256 for fixing the string or the like 3. At a top end of the string-attaching portion 234, there is provided an expanded head portion 250 a diameter of which is larger than that of the inserting hole 231 of the main portion 226.

The cover body 203 is in a rectangular-parallel-piped shape comprising the top wall 211 and the right and left side walls 212 without front and rear walls, which forms an inverted U-shaped cross section as a whole. Therefore, the cover body 203 comprises the accommodating portion 215 which is an inner space having surrounding walls of the top wall 211 and the right and left side walls 212 in which the first and second sliders 21*a*, 21*b*, the connecting body 204 and the expanded head portion 250 of the string-attaching portion 234.

In the cover body 203, protruding portions 218 which protrude on centers of the right and left side walls 212 with gaps in an up-and-down direction and concave grooves 217 corresponding to a thickness of the connecting body 204 are formed between the protruding portions 218. On lower sides of the protruding portions 218, there are formed slope faces 219 declining toward bottom ends of the right and left side walls 212. In the cover body 203 of this kind, by pushing the protruding portions 218 on a lower side toward the main portion 226 of the connecting body 204, the right and left side walls 212 are elastically deformed in a direction separating from each other, the main portion 226 moves along the slope faces 219 to be fitted in the concave grooves 217 over the protruding portions on the lower side. After that, the right and left side walls 212 elastically returns to their original shapes so as to engage the main portion 226 stably. In the meantime, it is possible to form the concave groove 217 entirely in a length direction of the right and left side walls 212 of the cover body in which the main portion 226 of the connecting body 204 is fitted from both end sides of the cover body 203.

The adjuster of the string-end-fixing portion according to the seventh embodiment is assembled as described hereinafter. Specifically, the attaching levers 233 on both ends of the connecting body 204 having the string-attaching portion 234 attached on its main portion 226 are inserted in the attaching post portions 260*a*, 260*b* of the first and second sliders 21*a*, 21*b*, and then the attaching post portions 260*a*, 260*b* of the first and second sliders 21*a*, 21*b* are crimped respectively to connect the first and second sliders 21*a*, 21*b*.

Furthermore, an end of the string or the like 3 is inserted in the pair of the fixing leg portions 256 provided at the lower end portion of the string-attaching portion 234, and then the fixing leg portions 256 are crimped. With this, the fixing projections provided on front ends of the fixing leg portion 256 bite into the string or the like 3 so as to fixed the string or the like 3 to the string-attaching portion 234. At this time, by pulling down the string or the like 3, it is possible to securely fit the string-attaching portion 234 into the inserting hole 231 of the connecting body 226. At an end, by fitting the main portion 226 of the connecting body 204 into the concave grooves 217 in the connecting body 204, the adjuster of the string-end-fixing portion according to the seventh embodiment is obtained.

Eighth Embodiment

Figure 25:
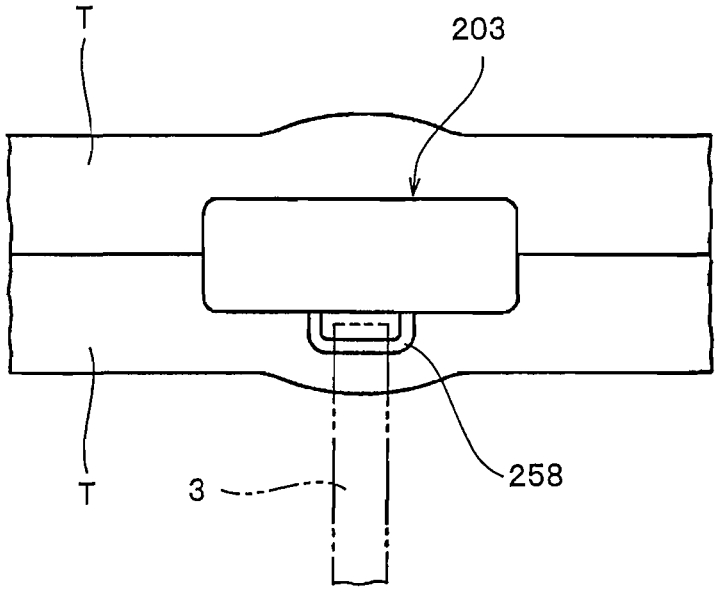
FIG. 25 is a plane view of an adjuster of a string-end-fixing portion according to an eighth embodiment.

FIG. 25 shows an adjuster of the string-end-fixing portion of an article according to an eighth embodiment.

In the adjuster of the string-end-fixing portion 10 according to the eighth embodiment, a string-attaching portion 258 for attaching the string or the like 3 is provided on an outer face of the cover body 203 covering the first and second sliders 21*a*, 21*b*. The string-end-fixing portion according to the eighth embodiment having this structure is useful when the string or the like is required to be disposed on a front face side of the adjuster of the string-end-fixing portion 10.

Next, usage examples of the adjuster of the string-end-fixing portion of the article according to the invention are specifically described hereinafter with reference to the drawings. The following description describes some usage examples and the invention is not limited to these examples.

Firstly, a specific example in which the adjuster of the string-end-fixing portion 10 of the article according to the first embodiment is attached to a sport shirt 100 is described with reference to the FIGS. 1-5, 26 and 27. As shown in these drawings, the adjuster of the string-end-fixing portion 10 is attached by sewing or the like along an opening portion linearly extending in an up-and-down direction formed in a chest portion of the sport shirt 100. As to an attaching method, a pair of the tapes with the elements T of the adjuster of the string-end-fixing portion 10 is sewed along the opening portion (opening). It is possible to sew a backing cloth together on a rear face side of the adjuster of the string-end-fixing portion or it is possible to dispose the string or the like between a front cloth and the backing cloth of the sport shirt 100. The backing cloth is not necessary to be disposed on an all over the sport shirt 100. Furthermore, if the backing cloth is disposed in a tunnel shape along the string or the like 3, it works as a guide channel.

Figure 26:
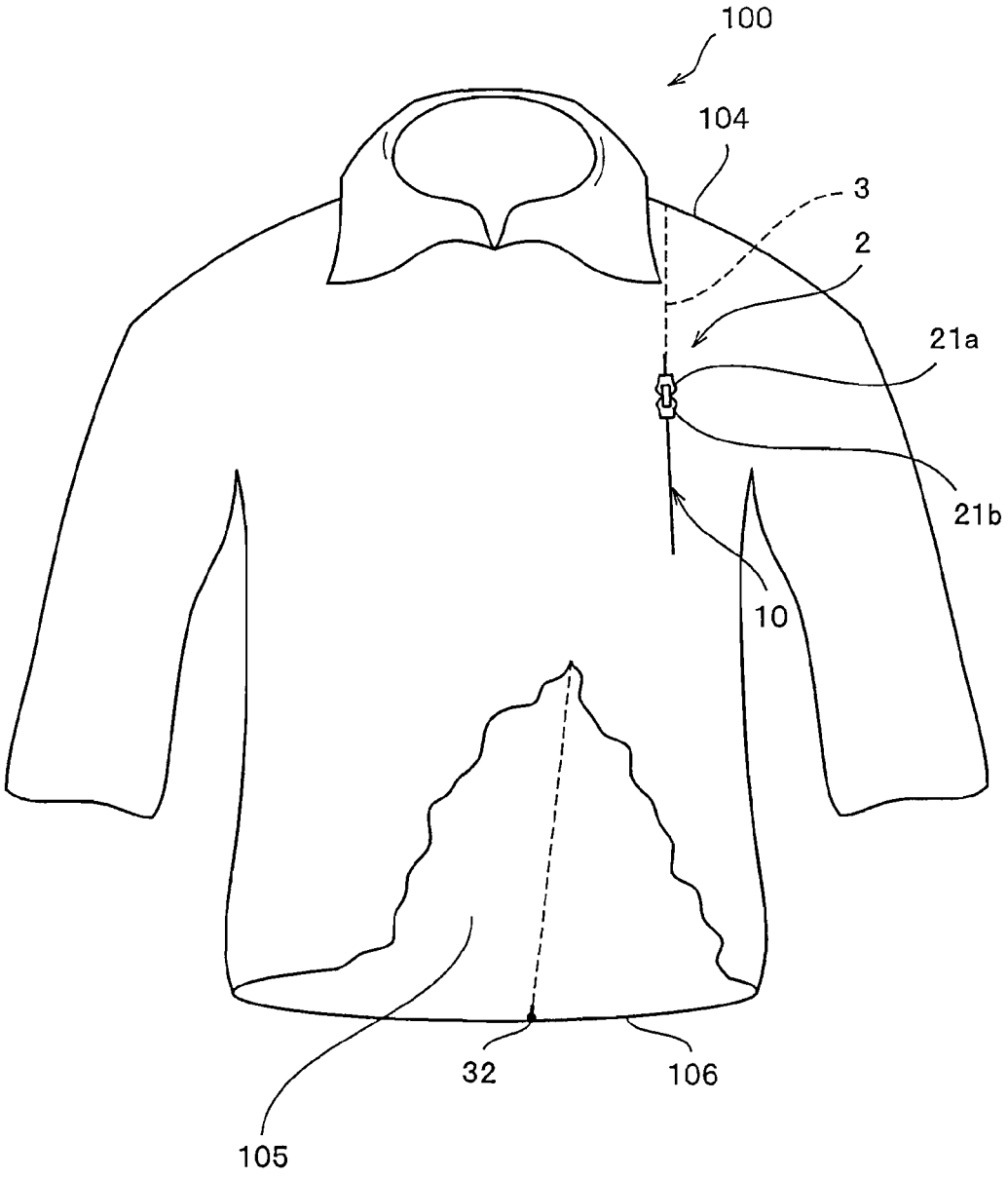
FIG. 26 is an elevation view sterically showing a partially cut and opened steady sport shirt or the like provided with the adjuster of the string-end-fixing portion according to the first embodiment.

On the other hand, one end 31 of the string or the like 3 is attached to the string-attaching portion 28 disposed on the lower plate 23*b* of the second slider 21*b* of the adjuster of the string-end-fixing portion 10 and the string or the like 3 is arranged to a back portion 105 over a shoulder portion 104 of the sport shirt 100, then extended downward so that the other end 32 is fixed to a center of a bottom of the sport shirt 100. In an illustrated example, when the slider 2 is pulled up to a top end, the bottom 106 of the sport shirt 100 is in a shape not being pulled up as shown in FIG. 26. When the slider 2 is slid downward, the bottom 106 of the sport shirt 100 is in a shape being pulled up by the other end 32 of the string or the like 3.

Figure 27:
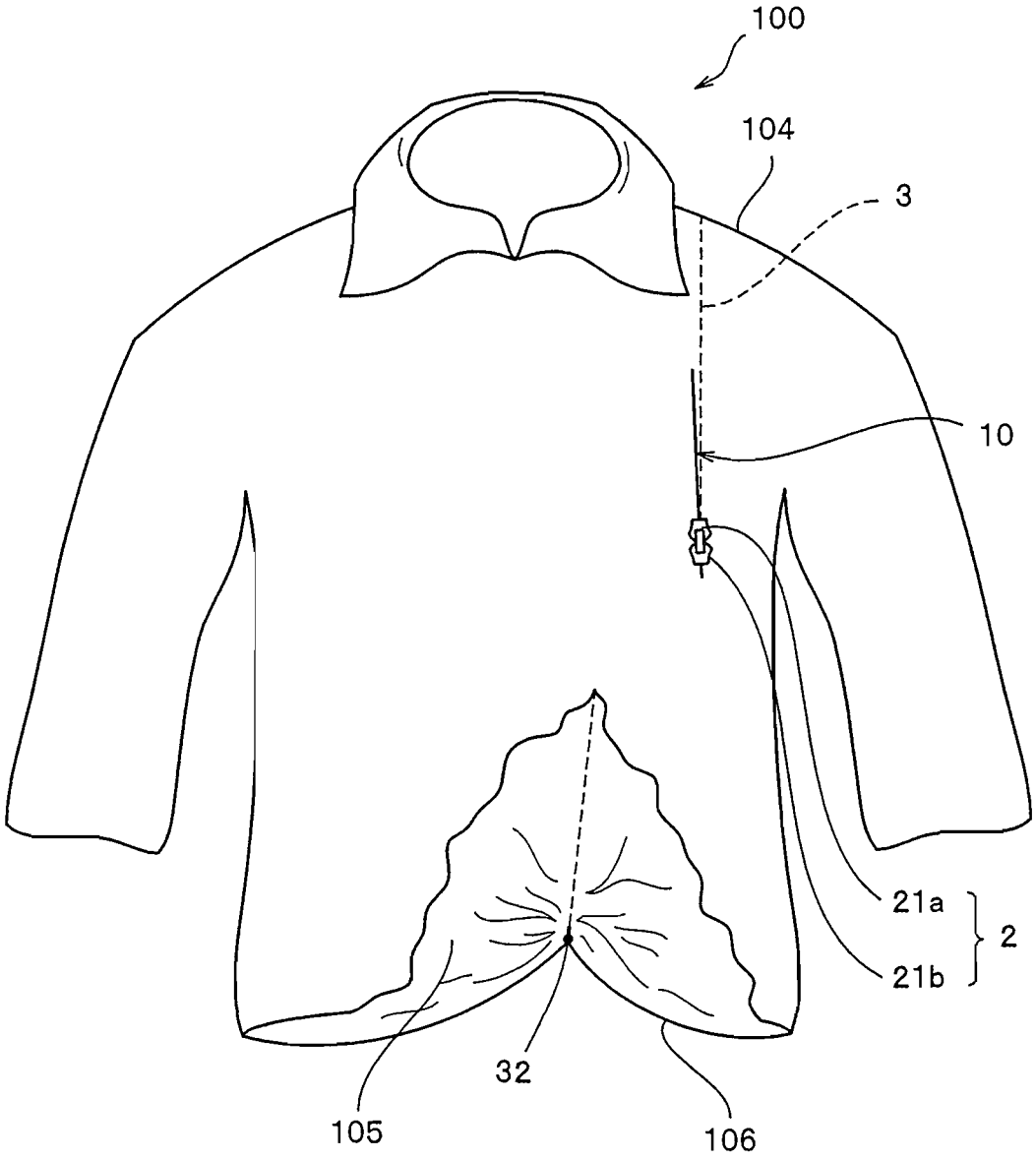
FIG. 27 is an elevation view sterically showing the partially cut and opened sport shirt, a back of which is hauled up.

When the bottom 106 of the sport shirt 100 is pulled up by the adjuster of the string-end-fixing portion 10 according to the first embodiment which moves the string-end-fixing portion of the bottom of the sport shirt 100, a pulling tape 35 attached to the connecting member 27 of the slider 2 projected on a front face from a chest portion of the sport shirt 100 is held by a hand and pulled downward. By this pulling-down operation, an engagement of the stopper pawl member 29 in the elements E is automatically released, the first and second sliders 21*a*, 21*b* slide downward together on the element rows ER, which pulls down the string or the like 3 attached to the second slider 21*b* by a sliding distance of the slider 2. As a result, the other end 32 which is a bottom attaching end of the string or the like 3 is pulled up by the sliding distance of the slider 2, which pulls up the bottom portion 106 of the sport shirt 100 as shown in FIG. 27. At this time, if the pulling tape 35 is released from the hand, the stopper pawl member 29 engages with the elements E with the front-end-stopper pawl 29*c*-1 inserted in the gap between two elements E at a stop position of the slider by the urge of the compressed spring 4 so as to disable any further movement of the slider 2.

In the adjuster of the string-end-fixing portion 10 according to the first embodiment, the first and second sliders 21*a*, 21*b* is connected via the connecting portion 27*b* of the connecting member 27 with post portions 25*a*, 25*b* opposed to each other so as to move together at all times. As a result, in sliding operation of the slider 2, there is formed only a small gap piercing the adjuster of the string-end-fixing portion 10 between opposing portions of the first and second sliders 21*a*, 21*b*. Therefore, the element rows ER in front and back of the pair of the first and second sliders 21*a*, 21*b* are always engaged and closed. Thus, even if the slider 2 is moved to an arbitrary position on the element rows ER, the element rows ER are closed except the gap between the opposing portions of the first and second sliders 21*a*, 21*b* of the adjuster of the string-end-fixing portion 10, which prevents easy penetration of dust or liquid from an outside.

As aforementioned, according to the adjuster of the string-end-fixing portion 10 of the article according to the first embodiment, the string-end-fixing portion of the article in the adjuster of the string-end-fixing portion 10 is disposed at a portion where adjusting operation of the string-end-fixing portion is applied while the handling portion 20 of the string-end-fixing portion 10 of the article is disposed at a portion easy to handle. With this, it is possible to move and adjust the string-end-fixing portion apart from a disposed position of the adjuster of the string-end-fixing portion 10 via the string or the like 3 one end 31 of which is attached to the adjuster of the string-end-fixing portion 10 to an arbitrary position. Furthermore, a position of the string-end-fixing portion after being moved is maintained.

Furthermore, in the adjuster of the string-end-fixing portion 10 of the article according to the first embodiment, it is possible to form a gap having an appropriate distance between the opposing first and second sliders 21*a*, 21*b* by accordingly adjusting a length of the connecting member 27 in a sliding direction of the slider. With this gap, even if the string or the like 3 is loosed from the string-attaching portion 28 by any chance, fingers can be inserted through the gap to pick up an end of the string or the like and attach to the string-attaching portion 28. Furthermore, in a case that the connecting member 27 can be detached form the first and second sliders 21*a*, 21*b*, by separating the first and second sliders 21*a*, 21*b*, it is easy to attach the end of the string or the like 3 to the string-attaching portion 28.

Figure 28:
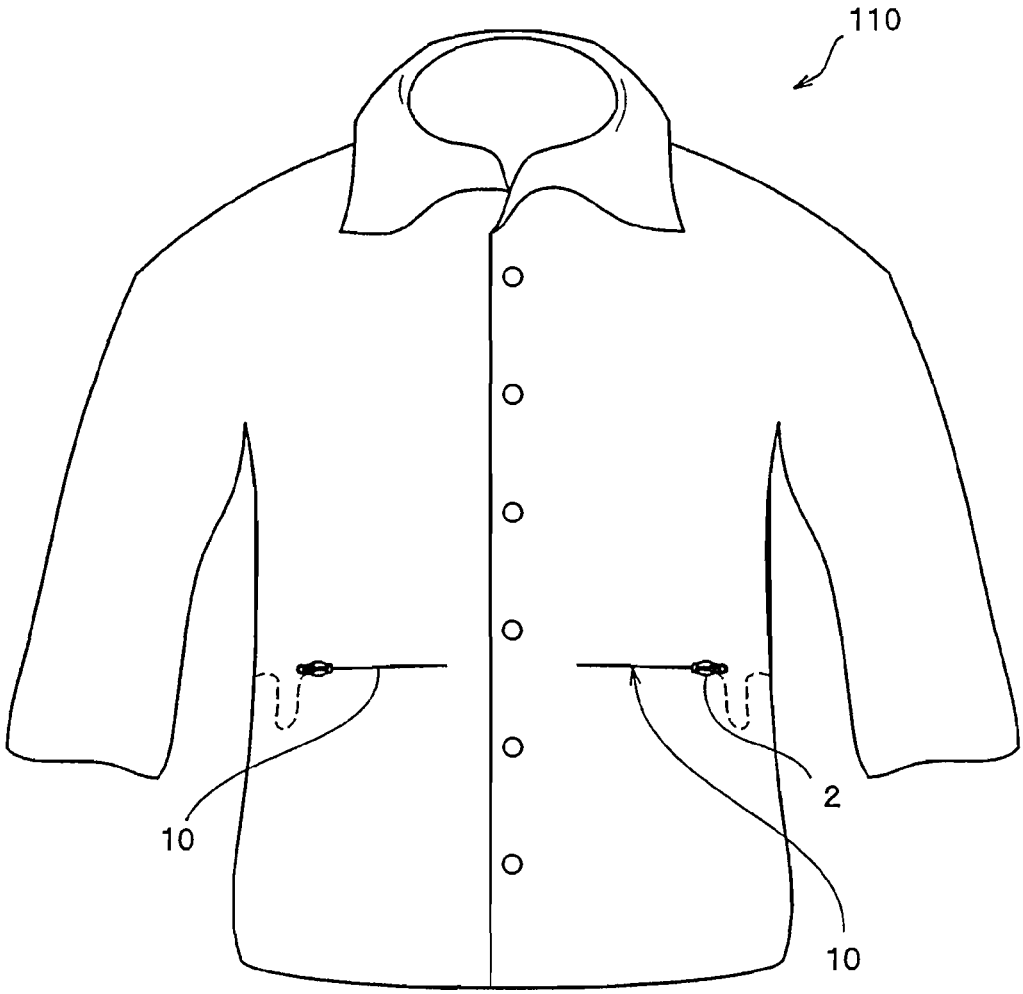
FIG. 28 is an elevation view sterically showing a blouse in a state that its abdominal part is not narrowed down by using the adjuster of the string-end-fixing portion according to the first embodiment.
Figure 29:
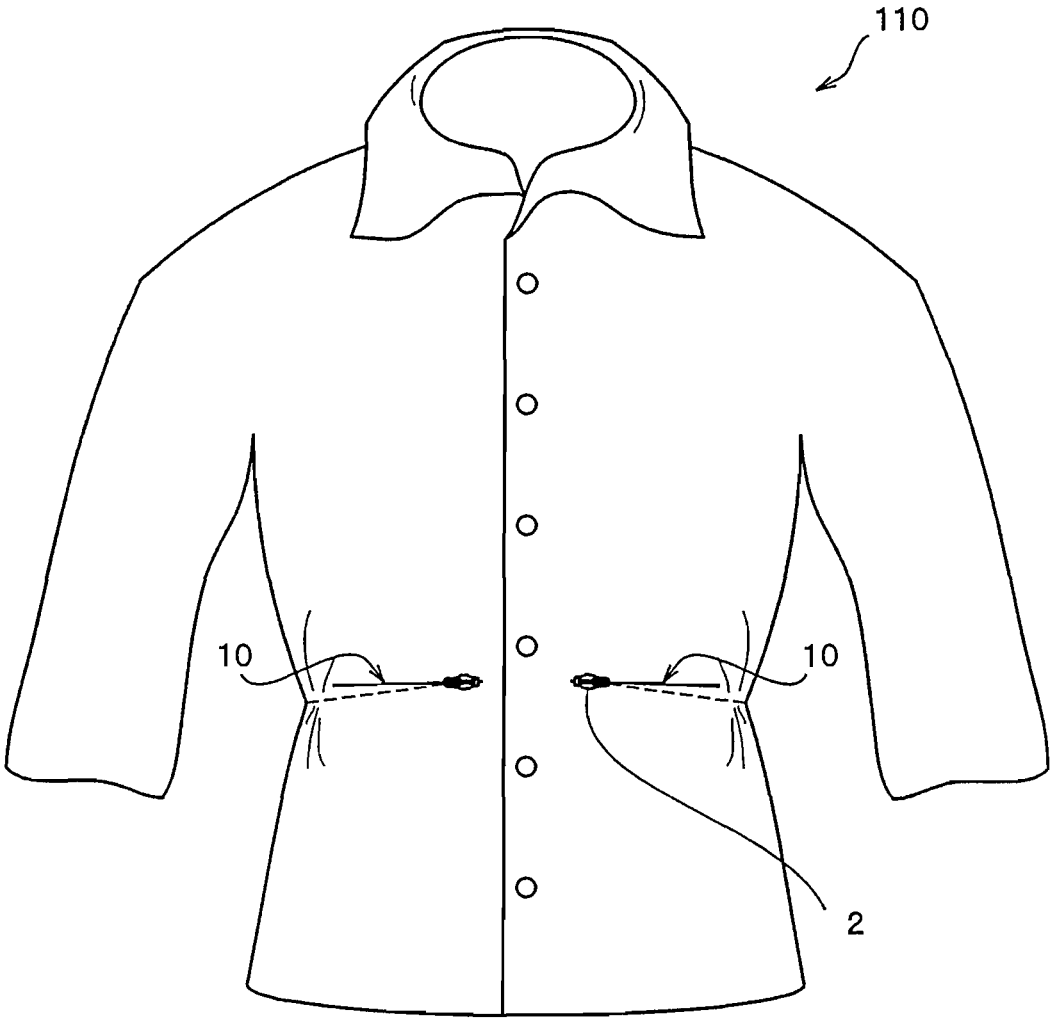
FIG. 29 is an elevation view sterically showing the same blouse in a state that its abdominal part is narrowed down.

Further, as shown in FIGS. 28 and 29, pairs of the tapes with the elements T of the adjusters of the string-end-fixing portions 10 of the article are sewed along openings linearly formed in a transversal direction in abdominal parts of right and left front bodies of a blouse 110. At this time, ends 31 on one side of the strings or the like 3 are tied to the string-attaching portions 28 disposed on the bottom faces of the respective lower plates 23*b* of the sliders 2 of the adjusters of the string-end-fixing portions 10 disposed on right and left while the other ends 32 of the strings or the like 3 are respectively fixed on inner sides of lower abdominal parts below right and left auxiliary portions of the blouse 110. Lengths of the strings or the like 3 up to the string-end-fixing portions are set substantially equal to or slightly longer than distances between the sliders 2 disposed on right and left which are beneath and in closest positions to the auxiliary portions in the openings and attaching positions of the other ends of the strings or the like 3 beneath the auxiliary portions. Furthermore, at parts of the blouse 110 where the adjusters of the string-end-fixing portions 10 and the strings or the like 3 are disposed, backing cloths in a tunnel shape are sewed (not shown) and the strings or the like 3 are inserted in tunnel-shaped guide spaces between the backing cloths and front cloths.

The blouse 110 in which the adjusters of the string-end-fixing portions 10 and strings or the like 3 are attached as aforementioned is, as shown in FIG. 28, in a state in which its abdominal portion is most outspreaded when the sliders of the adjusters of the string-end-fixing portions 10 on right and left are slid toward the attaching portions of the other ends 32 of the strings or the like 3. On the other hand, the blouse 110 is in a state in which its abdominal portion is most narrowed down as shown in FIG. 29 when the sliders 2 are closest on mating sides of the right and left front bodies. Due to sliding positions of the sliders, positions of the string-end-fixing portions are changed so as to change a narrowing-down degree of a circumference of the abdominal part of the blouse. At stop positions of the sliders 2, stopper pawl mechanisms are actuated so as to stop the sliding of the sliders 2. In this second usage example as well, regardless of sliding of the sliders 2, the element rows ER in front and back of the sliders 2 in a sliding direction are always engaged and closed.

However, as to the adjuster of the string-end-fixing portion 10 of the article according to the invention, it may be required that the attaching portion of the adjusters of the string-end-fixing portions 10 can be opened and closed by sliding operation of the slider as an ordinary slide fastener. For example, when rolling up a window portion of a tent or the like and maintaining such a state, the adjuster of the string-end-fixing portion 10 of the article can be suitably used. It is preferable from a sanitary viewpoint to enable to open and close the attaching portion of the adjuster of the string-end-fixing portion 10 at the same time when opening and closing the window portion because a circulation of air in the tent becomes good.

FIGS. 30-33 shows a usage example in which the adjuster of the string-end-fixing portion 10 of the article according to the third embodiment is adopted to a tent 120. The adjuster of the string-end-fixing portion 10 is disposed apart from a window portion 122 of the tent main body 121. For example, it is disposed near an entrance 123. Therefore, an opening 124 in a linear shape is formed in a part around the entrance 123. Right and left tapes with the elements T are sewed or adhered along the opening 124. It is preferable that the tapes 1 are water proof tapes made of fiber tapes with thermoplastic synthetic resin coated thereon or of tapes of thermoplastic synthetic resin. According to the illustrated example, the adjuster of the string-end-fixing portion 10 is attached to the tent main body 121 so as to be adjoining to the entrance 123 in a rectangular shape longer in an up-and-down direction and extend in an up-and-down direction, wherein the first and second sliders 21*a*, 21*b* are mounted on the element rows ER of the tapes with the elements.

Figure 32:
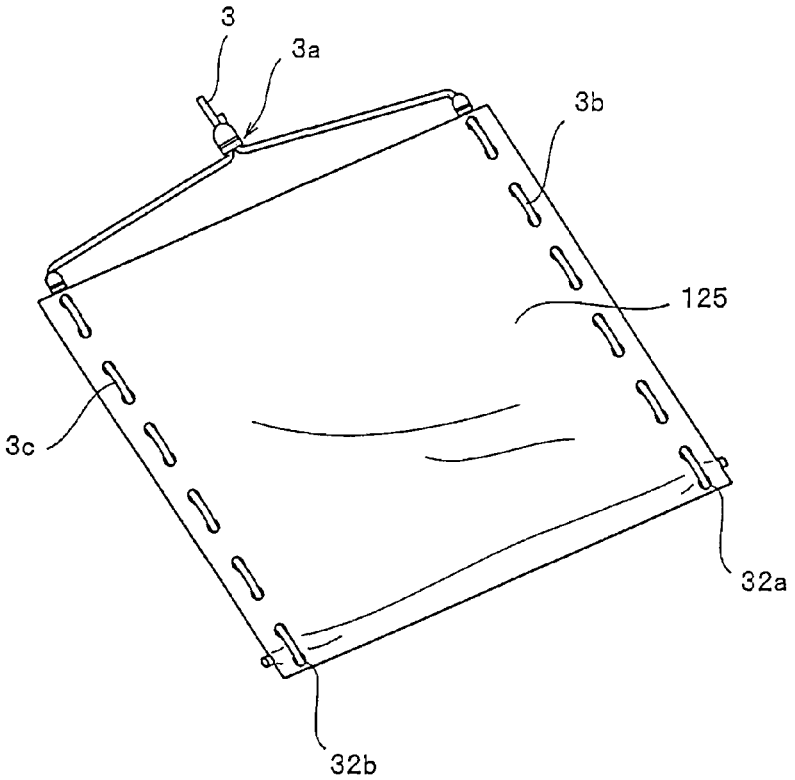
Figure 33:
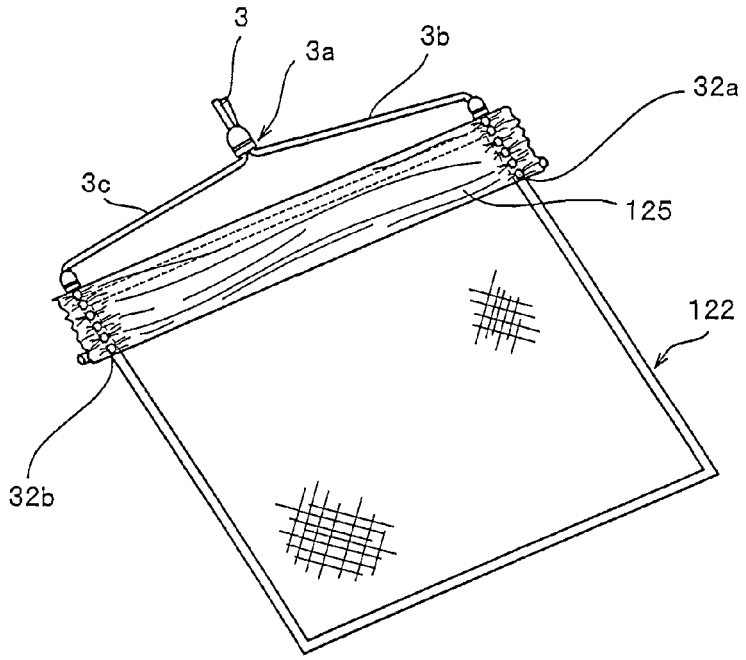

The string or the like 3, one end of 31 of which is tied to a string-attaching portion 166 provided on the lower portion 163 of the second slider 21*b*, extends upward along an inner face of the tent main portion 121 up to above the window portion 122 after turning its direction at a turning portion of a ceiling portion. Furthermore, the string or the like 3 is branched in right and left directions at a bifurcation portion 3*a* above the window portion 122. As shown in FIGS. 32 and 33, branched strings or the like 3*b*, 3*c* are guided along a top edge portion of the window portion 122, and then inserted and guided alternately in an inside and an outside of right and left side edge portions of a sheet 125 for opening and closing a window, a top end of which is positioned and fixed at the top edge portion of the window portion 122. Other end portions 32*a*, 32*b* is attached and fixed at right and left lower end edges of the sheet 125 for opening and closing the window.

In the adjuster of the string-end-fixing portion 10, as aforementioned, when the slider 2 is stopped, by the stopper pawl member 29 and the compressed spring 4 of the first slider 21*a*, the front-end-stopper pawl 29*c*-1 of the stopper pawl member 29 is urged so that the front-end-stopper pawl 29*c*-1 of the stopper pawl member 29 can project into the element guide channel 24*a* through the element engaging window 22*a*-1. Furthermore, in sliding operation of the slider 2, if the connecting member 27 is held and pulled up, the connecting portion 27*a* of the connecting member 27 is lifted upward against an urge by the compressed spring 4 due to a pulling-up force. With this operation, the automatic stopper pawl member 29 rotates upward with the base end portion 29*a* of the stopper pawl member 29 as its rotation center so that that the front-end-stopper pawl 29*c*-1 is disengaged upward from the element guide channel 24*a*. As a result, an engagement of the front-end-stopper pawl 29*c*-1 entering in the gap between the elements E of the element row ER can be automatically released.

If, for example, a knot of the string or the like 3 is loosed and the string or the like 3 is detached from the string-attaching portion 166 due to some sort of reasons, by pushing the projection 167*a* of the second slider 21*b*, the sliding piece 167 is slid in the sliding groove and the sliding piece inserting hole 162*a* in a direction of the post portion 164 against an urge of the compressed spring 168 so as to remove the second cylindrical-stick-shaped connecting piece 184 of the connecting member 27 is taken out. Removing the second cylindrical-stick-shaped connecting piece 184 of the connecting member 27 allows the second slider 21*b* to freely slide along the element rows ER so s to form an arbitrary opening portion with respect to the first slider 21*a* where the elements E are not engaged. Fingers can be inserted into the opening portion so as to pick up a loosed end of the string or the like 3 and securely tie it to the string-attaching portion 166 of the second slider 21*b*. After that, the sliding piece 167 is slid in a direction to the post portion 164 against the urge by pushing the projection 167*a* of the sliding piece 167 so that the gap is formed between the projection 167*a* and the end portion of the connecting-member-attaching post 165 on the extended side through which the second cylindrical-stick-shaped connecting piece 184 of the connecting portion 27 is inserted. Then, when the pushing of the projection 167*a* is released, the sliding piece 167 is automatically returns to its original position due to an urge of the compressed spring 168, which prevents the second cylindrical-stick-shaped connecting piece 184 from released from the connecting-member-attaching post 165.

Further, in this usage example, since the adjuster of the string-end-fixing portion according to the third embodiment is used, the connecting member 27 connects the first and second sliders 21*a*, 21*b* so as to cover an entirety of the first and second sliders 21*a*, 21*b*. Therefore, if the connecting member 27 has a waterproof structure around the slider body 161, rain can not penetrate through the gap between the first and second sliders 21*a*, 21*b* even if it rains, thereby preventing an inside of the tent from being wet too much.

Figure 30:
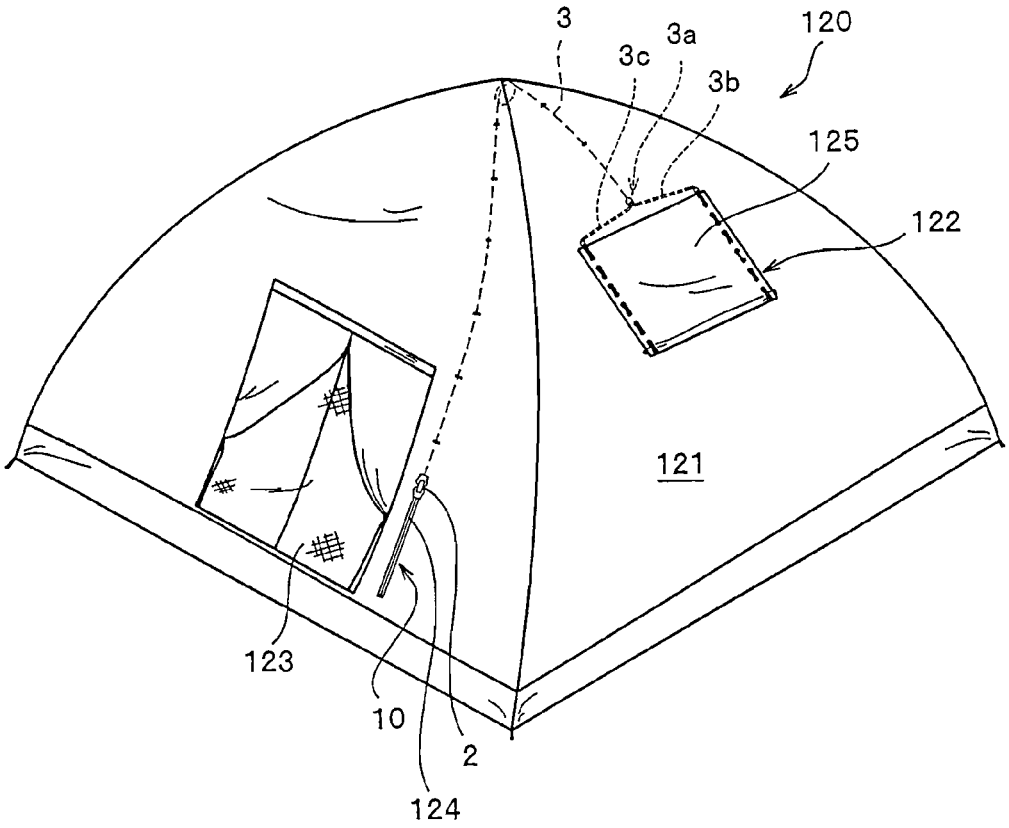
FIG. 30 is an entire perspective view showing a tent provided with the adjuster of the string-end-fixing portion according to the third embodiment, a window of which is closed.
Figure 31:
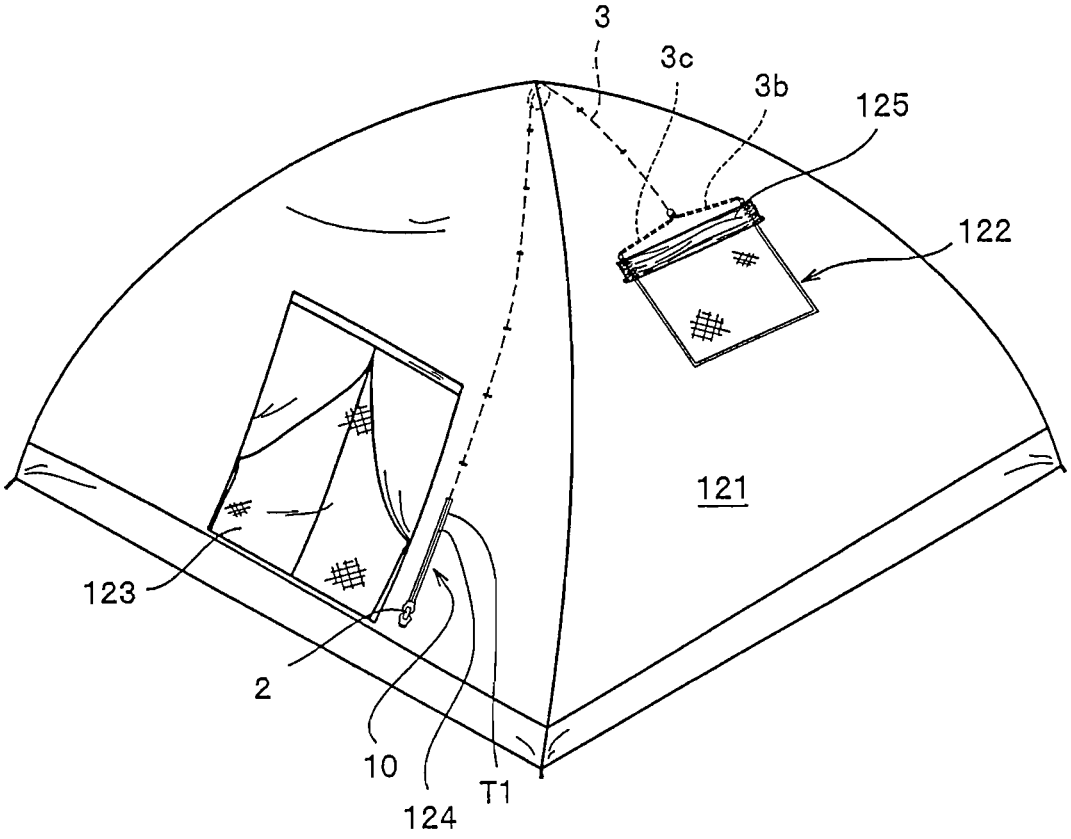
FIG. 31 is an entire perspective view showing the same tent whose window is opened by using the adjuster of the string-end-fixing portion.

In the aforementioned structure, when the window portion 122 is closed with the window-opening-and-closing sheet 125, as shown in FIG. 30, the slider 2 is slid up to a top end of the opening 124 where the adjuster of the string-end-fixing portion is attached. At this time, the element rows ER of right and left faster stringers T1 are engaged and the opening 124 is closed. When the slider 2 is slid toward a lower end of the opening 124, one end 31 of the string or the like 3, the other end of which is attached to the string-attaching portion 166 of the second slider 21*b*, is pulled down. Consequently, the end portions 32*a*, 32*b* of the branched strings or the like 3*b*, 3*c* on right and left are pulled up via the turning portion of the ceiling portion of the tent main body 121 so that the sheet 125 for opening and closing the window is sequentially hauled up from a lower end side toward a top end side thereof so as to open the window portion 122 as shown in FIG. 31. Off course, the first slider 21*a* in this usage example comprises the stopper pawl mechanism which is not shown. Therefore, if a sliding of the slider 2 is stopped halfway so as to, for example, open the window portion 122 halfway and then, the connecting member 27 of the slider 2 is released from fingers, the slider does not move and an opening degree of the window portion 122 does not change, either.

Figure 34:
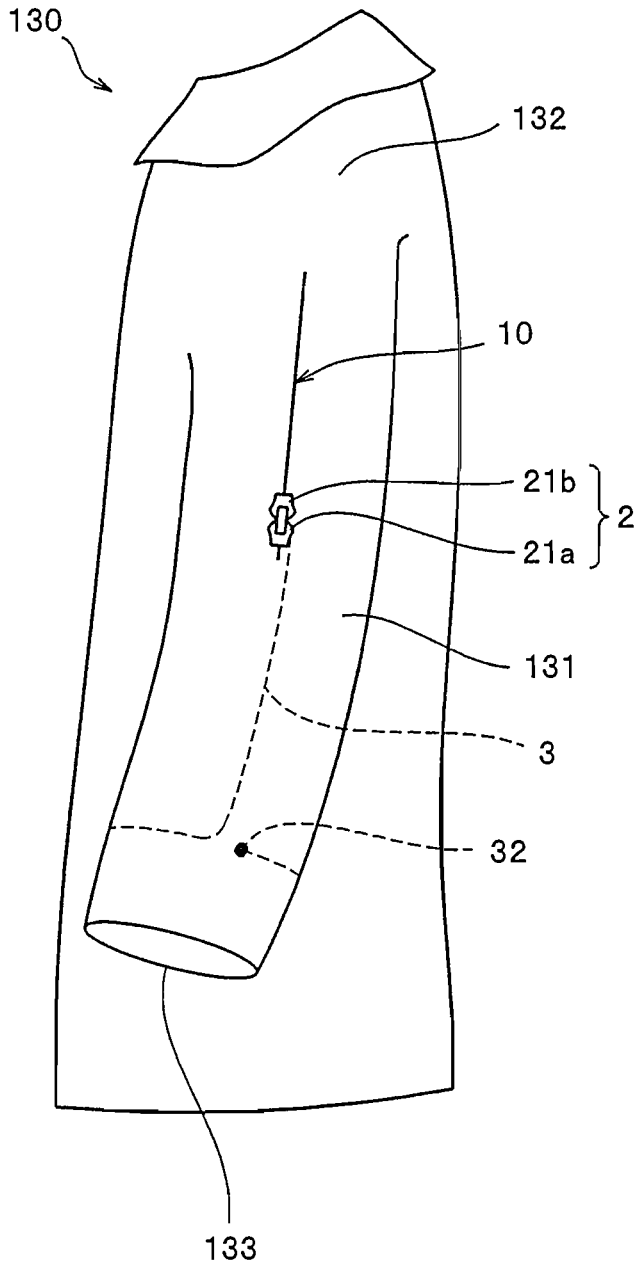
FIG. 34 is a side view of a jacket or the like on which a string or the like of the invention is adopted.
Figure 35:
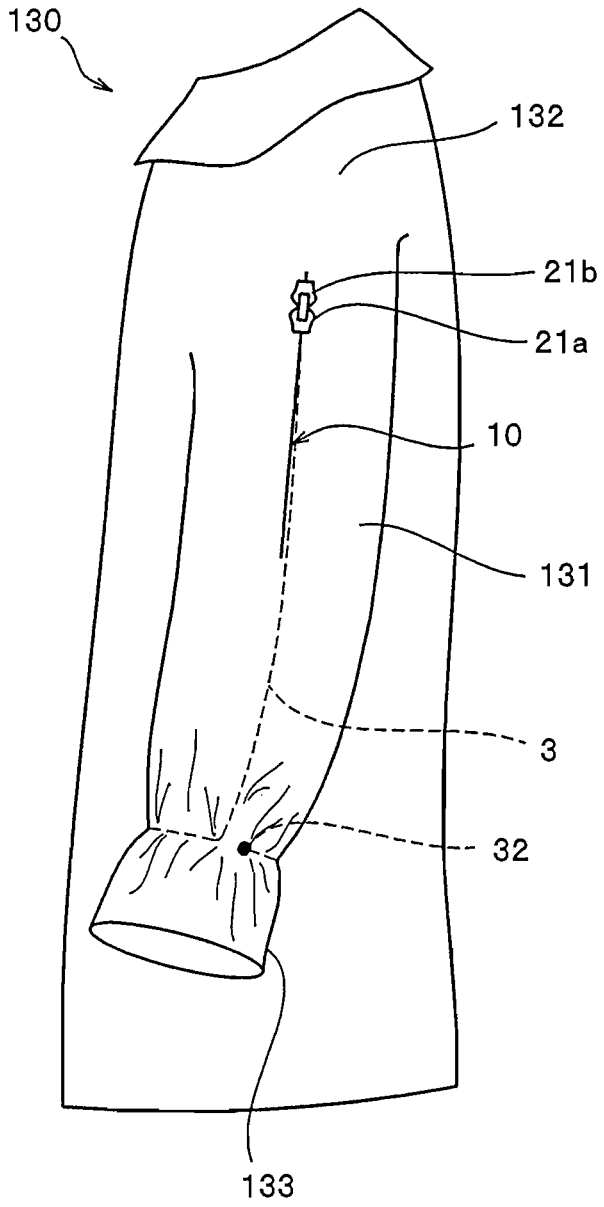

FIGS. 34 and 35 show an usage example of the adjuster of the string-end-fixing portion 10 according to the first embodiment which is used to adjust the string-end-fixing portion on a circumference of a cuff of a jacket or the like 130. According to these drawings, the adjuster of the string-end-fixing portion 10 is linearly attached on the jacket or the like 130 from its shoulder portion 130 to a part of a way to the cuff 131. On the other hand, the string or the like 3, one end 31 of which is fixed to a bottom face of the second slider 21 of the slider 2, is guided in a direction to the cuff along an inner side of the sleeve portion 131. Furthermore, the string or the like 3 is guided to make a circuit around a portion of the sleeve portion 133 to be narrowed down and the other end 32 thereof is fixed to an end. With this structure, when the slider 2 is pulled down at a lower end of a position of the adjuster of the string-end-fixing portion, the sleeve portion 133 maintains its ordinary shape as shown in FIG. 34. On the contrary, when the slider 2 is pulled up at a higher position, the string or the like 3 are also pulled up by pulled-up movement of the slider 2. With this, a circuit diameter of the string or the like disposed at the portion of the sleeve portion 133 to be narrowed down becomes gradually small and the sleeve portion 133 is finally narrowed down as shown in FIG. 35.

In the meantime, the aforementioned usage examples are described base on cases in which the adjuster of the string-end-fixing portion 10 of the article according to the first or third embodiment of the invention is used. However, the invention is not limited to these cases, but the adjuster of the string-end-fixing portion of the article according to another embodiment or other adjuster of a string-end-fixing portion of a article of the invention can be used.

As aforementioned, according to the adjuster of the string-end-fixing portion 10 of the article on the invention, it is possible to easily change a portion of the string-end-fixing portion of the article by adding a slight improvement to a conventional slide fastener and in a case that the stopper pawl member is provided at the same time, an adjusted position of the string-end-fixing portion is automatically maintained. Furthermore, in a case that a portion where adjusting operation is carried out is disposed at a place easy to handle, even if the string-end-fixing portion of the article is apart from the portion where the adjusting operation is carried out, it is possible to easily and securely change the string-end-fixing portion. Furthermore, if the string or the like is loosed from the string-attaching portion, it is possible to easily attach it again. In the meantime, in the aforementioned embodiments, one end 31 of the string or the like 3 is tied and fixed to the string-attaching portion 28 on the lower plate 23*b* of the second slider 21*b* or the string-attaching post 210 of the cover body 203, however, it is possible to fix the end 31 by adhesion or sewing. Furthermore, as to the sliders and the stopper pawl mechanism, they are not limited to the aforementioned embodiment and it is possible to apply various designing modifications.

The adjuster of the string-end-fixing portion of the article according to the invention can be effectively used when adjusting a size or length of an article that is needed to adjust its size by narrowing it down, such as clothing, caps or hats, groves, bags, tents or the like.

The invention claimed is:

1. An adjuster of a string-end-fixing portion of an article for changing a second position in the article via a string by operating a handling portion disposed at a first position in the article, wherein the handling portion comprises:

two tapes, each having an element row of a plurality of elements for engaging and disengaging, the element row being fixed along an opposing side edge portion thereof;

first and second sliders in which both element rows are inserted and which engage and disengage the elements by sliding operation thereof; and a connecting member for connecting the first and second sliders, wherein the connecting member comprises a string attaching portion for attaching the string, the string attaching portion is inserted into a gap formed between the first and second sliders and through an opening in a connecting body, each of the first and second sliders comprises an upper plate, a lower plate, a post portion for defining an element guide channel between the upper and lower plates and connecting the upper and lower plates, and a connecting-member-mounting portion disposed on a top face of the upper plate, and the first and second sliders are connected via the connecting member so that the post member of each of the first and second sliders is opposed to each other, wherein the connecting member comprises a cover body for covering the first and second sliders from above and the connecting body attached to the cover body for connecting a connecting-member-mounting portion of the first slider and a connecting-member-mounting portion of the second slider.

2. The adjuster of the string-end-fixing portion according to claim 1, wherein the first slider comprises a stopper pawl member for stopping sliding of the first slider by elastically entering a gap between the adjoining elements when the sliding is stopped, and for allowing the sliding of the first slider by separating from the gap between the elements in conjunction with the sliding operation via the connecting member against an elastic urge.

3. The adjuster of the string-end-fixing portion according to claim 1, wherein the connecting member and the first and/or second sliders are constructed so as to be engaged and disengaged.

4. The adjuster of the string-end-fixing portion according to claim 1, wherein the connecting body comprises a main portion and a pin inserting portion.

5. The adjuster of the string-end-fixing portion according to claim 1, wherein the connecting body is pivoted on the cover body so as to swing.

6. The adjuster of the string-end-fixing portion according to claim 1, wherein the string attaching portion is inserted into the gap from a top wall of the cover body.

* * * * *

UNITED STATES PATENT AND TRADEMARK OFFICE

CERTIFICATE OF CORRECTION

PATENT NO. : 8,819,901 B2
APPLICATION NO. : 11/916957
DATED : September 2, 2014
INVENTOR(S) : Koji Muratsubaki et al.

It is certified that error appears in the above-identified patent and that said Letters Patent is hereby corrected as shown below:

In the Specification

In column 4, line 16, delete “form” and insert -- from --, therefor.

In column 10, line 34, delete “the” and insert -- The --, therefor.

In column 11, line 58, delete “en” and insert -- an --, therefor.

In column 13, line 3, delete “form” and insert -- from --, therefor.

In column 14, line 26, delete “that that” and insert -- that --, therefor.

In column 21, line 21, delete “On” and insert -- One --, therefor.

In column 23, line 64, delete “form” and insert -- from --, therefor.

In column 24, line 56, delete “shows” and insert -- show --, therefor.

In column 25, line 36, delete “that that” and insert -- that --, therefor.

In column 25, line 53, delete “so s” and insert -- so as --, therefor.

Signed and Sealed this
Tenth Day of March, 2015

Michelle K. Lee

Michelle K. Lee
*Deputy Director of the United States Patent and Trademark Office*